US006434875B1

(12) United States Patent
Constant et al.

(10) Patent No.: US 6,434,875 B1
(45) Date of Patent: Aug. 20, 2002

(54) BACKSTRAP MODULE CONFIGURED TO RECEIVE COMPONENTS AND CIRCUITRY OF A FIREARM CAPABLE OF FIRING NON-IMPACT FIRED AMMUNITION

(75) Inventors: Robert L. Constant, Westfield; John F. Klebes, Feeding Hills, both of MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 09/629,532

(22) Filed: Jul. 31, 2000

(51) Int. Cl.[7] ..... F41A 19/00
(52) U.S. Cl. ..... 42/84; 42/70.11; 89/28.05
(58) Field of Search ..... 42/84, 70.11; 89/28.05

(56) References Cited

U.S. PATENT DOCUMENTS

| | | | | | |
|---|---|---|---|---|---|
| 520,468 | A | | 5/1894 | Wesson | |
| 3,580,113 | A | * | 5/1971 | Ramsay | 42/84 |
| 3,650,174 | A | | 3/1972 | Nelsen | 89/28 |
| 4,009,536 | A | * | 3/1977 | Wolff | 42/84 |
| 4,134,223 | A | * | 1/1979 | Hillenbrandt et al. | 42/84 |
| 4,275,521 | A | * | 6/1981 | Gerstenberger et al. | 42/84 |
| 4,467,545 | A | | 8/1984 | Shaw, Jr. | |
| 4,793,085 | A | | 12/1988 | Surawski et al. | 42/84 |
| 4,970,819 | A | | 11/1990 | Mayhak | |
| 5,040,463 | A | * | 8/1991 | Beaverson | 102/210 |
| 5,052,138 | A | * | 10/1991 | Crain | 42/1.02 |
| 5,074,189 | A | | 12/1991 | Kurtz | |
| 5,083,392 | A | | 1/1992 | Bookstaber | |
| 5,272,828 | A | | 12/1993 | Petrick et al. | 42/84 |
| 5,303,495 | A | | 4/1994 | Harthcock | |
| 5,448,847 | A | | 9/1995 | Teetzel | |
| 5,459,957 | A | | 10/1995 | Winer | |
| 5,625,972 | A | | 5/1997 | King et al. | 42/84 |
| 5,704,153 | A | | 1/1998 | Kaminski et al. | 42/70.11 |
| 5,755,056 | A | | 5/1998 | Danner et al. | 42/84 |
| 5,799,433 | A | | 9/1998 | Danner et al. | |
| 5,806,226 | A | | 9/1998 | Norton et al. | |
| 5,937,557 | A | | 8/1999 | Bowker et al. | |
| 5,937,558 | A | | 8/1999 | Gerard | |

* cited by examiner

*Primary Examiner*—Michael J. Carone
*Assistant Examiner*—M. Thomson
(74) *Attorney, Agent, or Firm*—McCormick, Paulding & Huber LLP

(57) ABSTRACT

A backstrap module configured to receive components and circuitry of a firearm capable of generating a firing signal from a firing apparatus for firing a non-impact ammunition cartridge along a firing axis includes a housing having an exterior surface which serves as a handgrip of the firearm, the operator's hand encircling the housing during a firing of the firearm. The backtrap module further comprises a circuitboard arrangement including a rigid circuitboard portion and a flexible circuitboard portion, the circuitboard arrangement being accommodated within the housing and configured to conform to the contours of the housing.

25 Claims, 30 Drawing Sheets

BACKSTRAP MODULE CONFIGURED TO RECEIVE COMPONENTS AND CIRCUITRY OF A FIREARM CAPABLE OF FIRING NON-IMPACT FIRED AMMUNITION

CROSS-REFERENCE TO RELATED APPLICATION

Some of the material disclosed herein is disclosed and claimed in the following issued U.S. Pat. No. 6,286,241, issued Sep. 11, 2001, entitled "FIRING CONTROL SYSTEM FOR NON-IMPACT FIRED AMMUNITION"; pending U.S. patent application Ser. No. 09/206,013, filed Dec. 4, 1998, entitled "FIREARM HAVING AN INTELLIGENT CONTROLLER"; issued U.S. Pat. No. 6,260,300, issued Jul. 17, 2001, entitled "BIOMETRICALLY ACTIVATED LOCK AND ENABLEMENT SYSTEM"; issued U.S. Pat. No. 5,717,156, issued Feb. 10, 1998, entitled "SEMI-AUTOMATIC PISTOL"; pending U.S. patent application Ser. No. 09/629,745, filed Jul. 31, 2000, entitled "A SECURITY APPARATUS FOR USE IN A FIREARM", pending U.S. patent application Ser. No. 09/642,753, filed Aug. 21, 2000, entitled "AN ELECTRIC FIRING PROBE FOR DETONATING ELECTRICALLY-FIRED AMMUNITION IN A FIREARM"; pending U.S. patent application Ser. No. 09/642,269, filed Aug. 18, 2000, entitled "A SLIDE ASSEMBLY FOR A FIREARM"; pending U.S. patent application Ser. No. 09/629,531, filed Jul. 31, 2000, entitled "A TRIGGER ASSEMBLY FOR USE IN A FIREARM HAVING A SECURITY APPARATUS"; pending U.S. patent application Ser. No. 09/643,024, filed Aug. 21, 2000, entitled "A METHOD OF ASSEMBLING A FIREARM HAVING A SECURITY APPARATUS"; pending U.S. patent application Ser. No. 09/629,534, filed Jul. 31, 2000, entitled "AN AMMUNITION MAGAZINE FOR USE IN A FIREARM ADAPTED FOR FIRING NON-IMPACT DETONATED CARTRIDGES"; pending U.S. patent application Ser. No. 09/616,722, filed Jul. 14, 2000, entitled "AN ELECTRONICALLY FIRED REVOLVER UTILIZING PERCUSSIVELY ACTUATED CARTRIDGES"; pending U.S. patent application Ser. No. 09/616,696, filed Jul. 14, 2000, entitled "AN ELECTRONIC SIGHT ASSEMBLY FOR USE WITH A FIREARM"; pending U.S. patent application Ser. No. 09/616,709, filed Jul. 14, 2000, entitled "A FIRING MECHANISM FOR USE IN A FIREARM HAVING AN ELECTRONIC FIRING PROBE FOR DISCHARGING NON-IMPACT FIRED AMMUNITION"; pending U.S. patent application Ser. No. 09/616,722, filed Jul. 14, 2000, entitled "A FIRING PROBE FOR USE IN A NON-IMPACT FIREARM"; pending U.S. patent application Ser. No. 09/616,837, filed Jul. 14, 2000, entitled "A SECURITY APPARATUS FOR AUTHORIZING USE OF A NON-IMPACT FIREARM"; pending U.S. patent application Ser. No. 09/616,697, filed Jul. 14, 2000, entitled "A BACKSTRAP MODULE FOR A FIREARM", which are hereby incorporated by reference as part of the present disclosure.

FIELD OF THE INVENTION

This invention pertains generally to firearms and, more specifically, to a backstrap module configured to receive components and circuitry of a firearm capable of firing non-impact fired ammunition.

BACKGROUND OF THE INVENTION

Over the years, there has been a continuous effort to improve the security and operation of conventional firearms.

Improvements in electronics technology has allowed certain mechanical firing systems and components in firearms to be replaced by electronic components. For example, a mechanical trigger bar is displaced by an electronic solenoid in U.S. Pat. No. 4,793,085, "ELECTRONIC FIRING SYSTEM FOR TARGET PISTOL". In U.S. Pat. No. 5,704,153, for a "FIREARM BATTERY AND CONTROL MODULE", a firearm using conventional percussion primers incorporates a processor into its ignition system.

Electronics have also been incorporated into ignition systems for firearms that use non-conventional primers and cartridges. U.S. Pat. No. 3,650,174, for "ELECTRONIC IGNITION SYSTEMS FOR FIREARM", describes an electronic control system for firing electronically-primed ammunition. The electronic control of the '174 patent, however, is hard-wired and lacks the multiple sensor interfaces of the programmable central processing unit that is found with the present invention. U.S. Pat. No. 5,625,972, for a "GUN WITH ELECTRICALLY FIRED CARTRIDGE", describes an electrically-fired gun in which a heat-sensitive primer is ignited by voltage induced across a fuse wire extending through the primer. U.S. Pat. No. 5,272,828, for a "COMBINED CARTRIDGE MAGAZINE AND POWER SUPPLY FOR A FIREARM", shows a laser ignited primer in which an optically transparent plug or window is centered in the case of the cartridge to permit laser ignition of the primer. Power requirements to energize the laser, as well as availability of fused and or laser-ignited primers are problematic, however. U.S. Pat. No. 5,755,056, for an "ELECTRONIC FIREARM AND PROCESS FOR CONTROLLING AN ELECTRONIC FIREARM", shows a firearm for firing electrically-activated ammunition having a cartridge sensor and a bolt position sensor. The technology of the '056 patent however, is limited to a firearm with a bolt action.

Much of the effort in recent years to integrate electronics into firearms stems from a desire to effectively restrict the person or persons who are able to operate the firearm. There have also been numerous attempts to incorporate external, mechanical locking devices such as keyed locks which prevent movement of the trigger or firing mechanism. The downside of such external locking devices is that they are often cumbersome and timely to disable, and thus impractical for use on the person or in situations where the firearm must quickly be readied to fire.

None of the firearms discussed or cited above disclose a modular, compact and ergonomically designed backstrap of a firearm which is capable of serving as a handgrip of the firearm while housing components vital to the operation of the firearm. The present invention is directed to such a backstrap module.

OBJECTS AND SUMMARY OF THE INVENTION

It is one object of the present invention to provide a backstrap module configured to receive components and circuitry of a firearm capable of firing non-impact fired ammunition.

It is another object of the present invention to provide a backstrap module for a firearm which is modular in design, thereby having improved reliability, maintainability, and manufacturability.

It is yet another object of the present invention to provide a backstrap module for a firearm which can give the operator of the firearm the tactile sensation of an impact fired firearm.

It is another object of the present invention to provide a backstrap module for a firearm with improved safety features, thereby reducing the possibility of an inadvertent discharge of an ammunition cartridge.

It is another object of the present invention to provide a backstrap module for a firearm which includes a display for informing an operator with vital firearm information.

According to the present invention, a backstrap module configured to receive components and circuitry of a firearm capable of generating a firing signal from a firing apparatus for firing a non-impact ammunition cartridge along a firing axis includes a housing having an exterior surface which serves as a handgrip of the firearm, the operator's hand encircling the housing during a firing of the firearm. The backtrap module further comprises a circuitboard arrangement including a rigid circuitboard portion and a flexible circuitboard portion, the circuitboard arrangement being accommodated within the housing and configured to conform to the contours of the housing.

These and other objects, features and advantages of the present invention will become more apparent in the light of the following detailed description of best mode embodiments thereof as illustrated in the accompanying drawings.

DETAILED DESCRIPTION OF THE INVENTION

Figure 1:
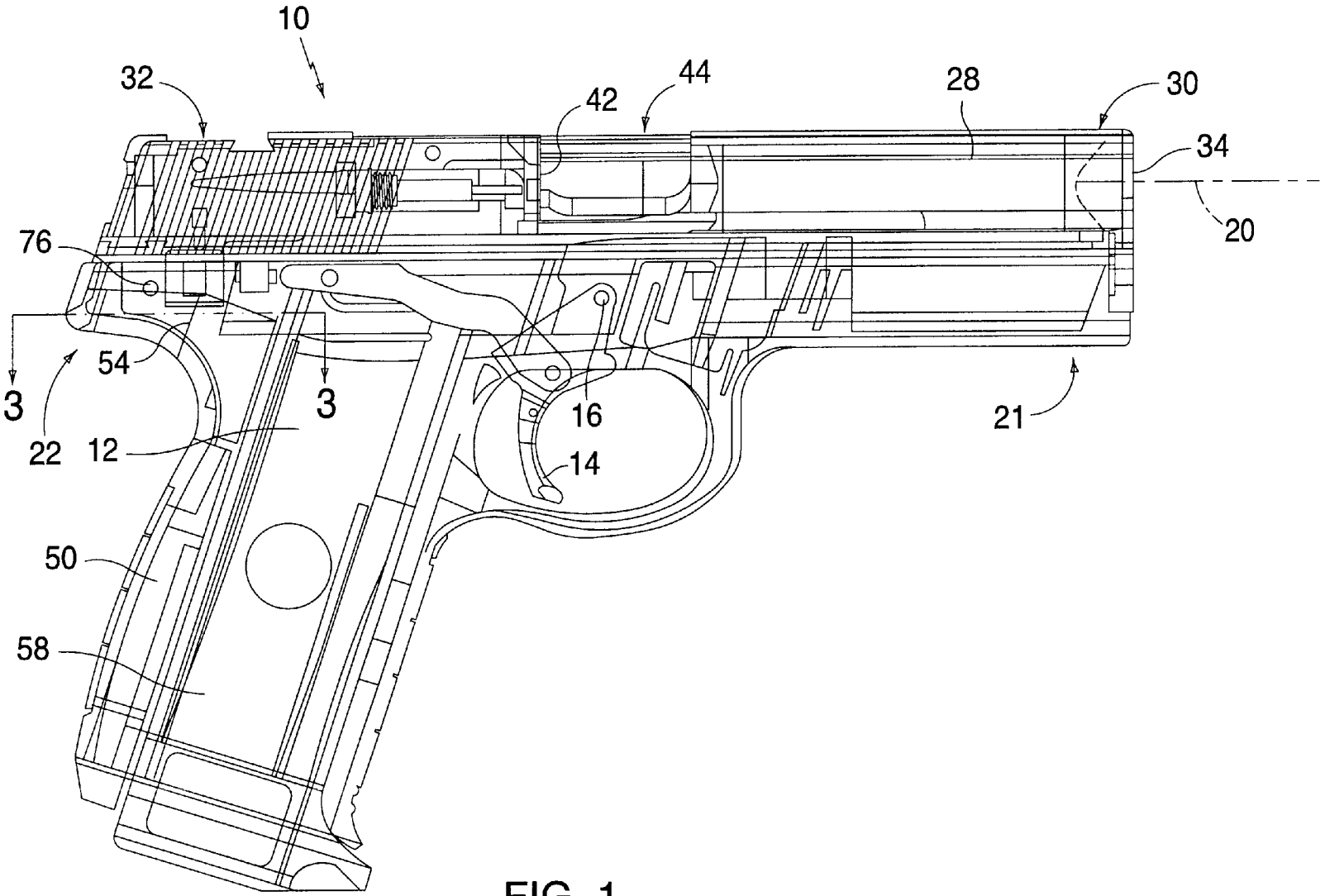
FIG. 1 is an elevated schematic view of a pistol according to the present invention, shown with a barrel captured between a slide assembly and a pistol frame.
Figure 2:
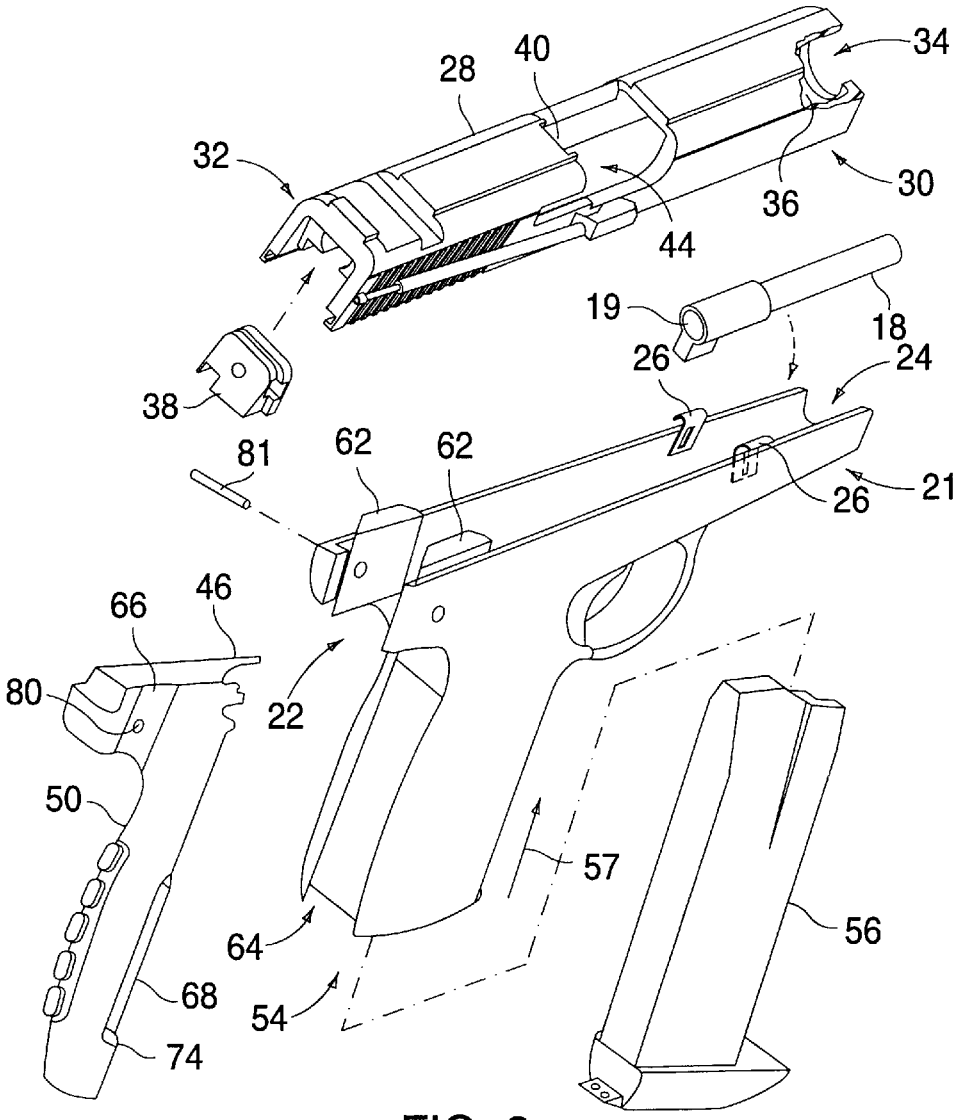
FIG. 2 is an exploded perspective view of the pistol of FIG. 1, showing a magazine and backstrap module disassembled from the pistol frame.
Figure 3:
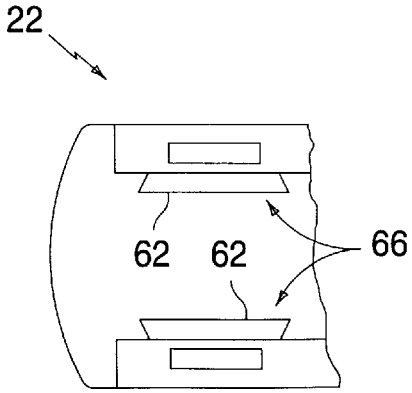
FIG. 3 is an enlarged plain view of the frame of FIG. 1 taken along lines 3—3.

Referring to FIGS. 1–3, a firearm of the present invention is configured in the form of a pistol 10 which includes a unitary frame 12, and a trigger 14 hung conventionally on the frame 12 by a transverse pin 16 for pivotal fore and aft movement therein. A barrel 18 has a bore 19 with a firing axis 20, and is fixed medially of forward and rear ends 21, 22 of the frame 12.

The frame 12 has an upwardly-open channel 24 extending over the length of the frame 12 from the forward end 21 to the rear end 22 thereof, and includes a pair of rails 26 on each upper edge of the frame 12, the rails 26 being spaced apart and configured in a known manner to receive a slide assembly 28 adapted for reciprocal, sliding movement along the frame 12.

The slide assembly 28 includes forward and aft ends 30, 32, the forward end 30 being retained, supported and guided during movement by the interrelationship of the barrel 18 and slide assembly 28. In that regard, an aperture 34 is provided through a front end wall 36 of the slide assembly 28 and which is adapted to receive therethrough the muzzle end of the barrel 18.

For a complete discussion of the forward end 30 of the slide assembly 28, and its functional relationship with the frame 12 and the barrel 18, refer to the semi-automatic pistol of U.S. Pat. No. 5,717,156, which was issued on Feb. 10, 1998, assigned to the same assignee as this application, and is hereby incorporated by reference as part of the present application.

A retainer 38 is inserted into the aft end 32 of the slide assembly 28 and acts with the aperture 34 to retain the slide assembly 28 in its assembled and parallel relationship to the rails 26 of the frame 12, and guide its reciprocal, longitudinal motion therealong which occurs whenever the pistol 10 is fired. The slide assembly 28 has a breech face 40, which forms a firing chamber 42 when engaged against the breech end of the barrel 18. As the slide assembly moves rearward on the frame 12 after firing, the firing chamber is exposed to an ejector port 44 of the slide assembly 28, through which spent cartridges are ejected by a conventional ejector 46.

The pistol 10 is configured with an array of sensitive electronic components which accomplish two broad objectives: to protect the firearm from unauthorized use; and to provide a firing signal that is sufficient to ignite an electrically-fired ammunition. In general terms, firearm components must be robust to endure the hostile environment encountered during normal use, especially in the area of the breech face 40. The environment of the breech face 40 is especially hostile, and effective integration of electronic components therein presents numerous concerns.

One concern is the long term effect of contamination build-up that results from normal use of the firearm. If the contaminants are electrically conductive, the transmission of electronic signals may be adversely effected after extended periods of use without proper firearm maintenance. For instance, as metallic cartridges are scraped over the breech face 40 when loaded into and ejected from the firing chamber 42, each cartridge deposits a small amount of casing material in the area of the breech face 40. The build-up of these metallic deposits around insulated electrical paths can compromise the transmission of electrical signals.

Another concern is the cumulative effect of highly repetitive impact, sheer, and frictional forces which are created by the loading, firing, and ejecting of cartridges. The breech face 40 bears a majority of the large recoil force generated by firing a cartridge, so the components must be durable and resistant to wear to ensure long-term, consistent operation of the pistol 10.

To protect the array of electronics, the rear end 22 of the frame 12 is adapted to receive a backstrap module 50. Together, the backstrap module 50 and frame 12 form an ergonomically-designed pistolgrip 58 which extends downwardly and rearwardly relative to the forward end 21 of the frame 12. A chamber 54 extends vertically through the frame 12 with a known configuration that receives an ammunition magazine 56 in a direction generally indicated by arrow 57.

The backstrap module 50 is positioned on the frame 12 by means of complementary pairs of dovetails and dovetail receivers. The rear end 22 of the frame 12 includes a pair of upper dovetails 62 and a lower dovetail receiver 64 which are configured, oriented, and positioned to cooperate, respectively, with a pair of upper dovetail receivers 66 and a pair of lower dovetails 68 of the backstrap module 50.

The backstrap module 50 is moved into position on the frame 12 by engaging its lower dovetails 68 with the lower dovetail receiver 64 of the frame 12 in the direction of arrow 57. As the backstrap module 50 is moved onto the frame 12, the upper dovetail receivers 66 receive the upper dovetails 62 of the frame 12. A transverse pin bore 80 extending transversely through the backstrap module is brought into alignment with a pair of frame mount holes 76 on the frame 12. A spring pin 81 is then inserted through the aligned holes to secure the backstrap module 50 to the frame 12. The spring pin 81 is sized to fit tightly through the pin bore 80 and snugly through the frame mount holes 76, so as not to damage the mount holes 76. The pin bore 80 has a metallic sleeve which receives the spring pin 81 and avoids damaging the material of the backstrap module 50.

Several embodiments of the slide assembly are described below, each of which has a different breech face and/or firing probe assembly configuration. The embodiment shown in FIGS. 4–6 is considered to be the best mode embodiment.

Figure 4:
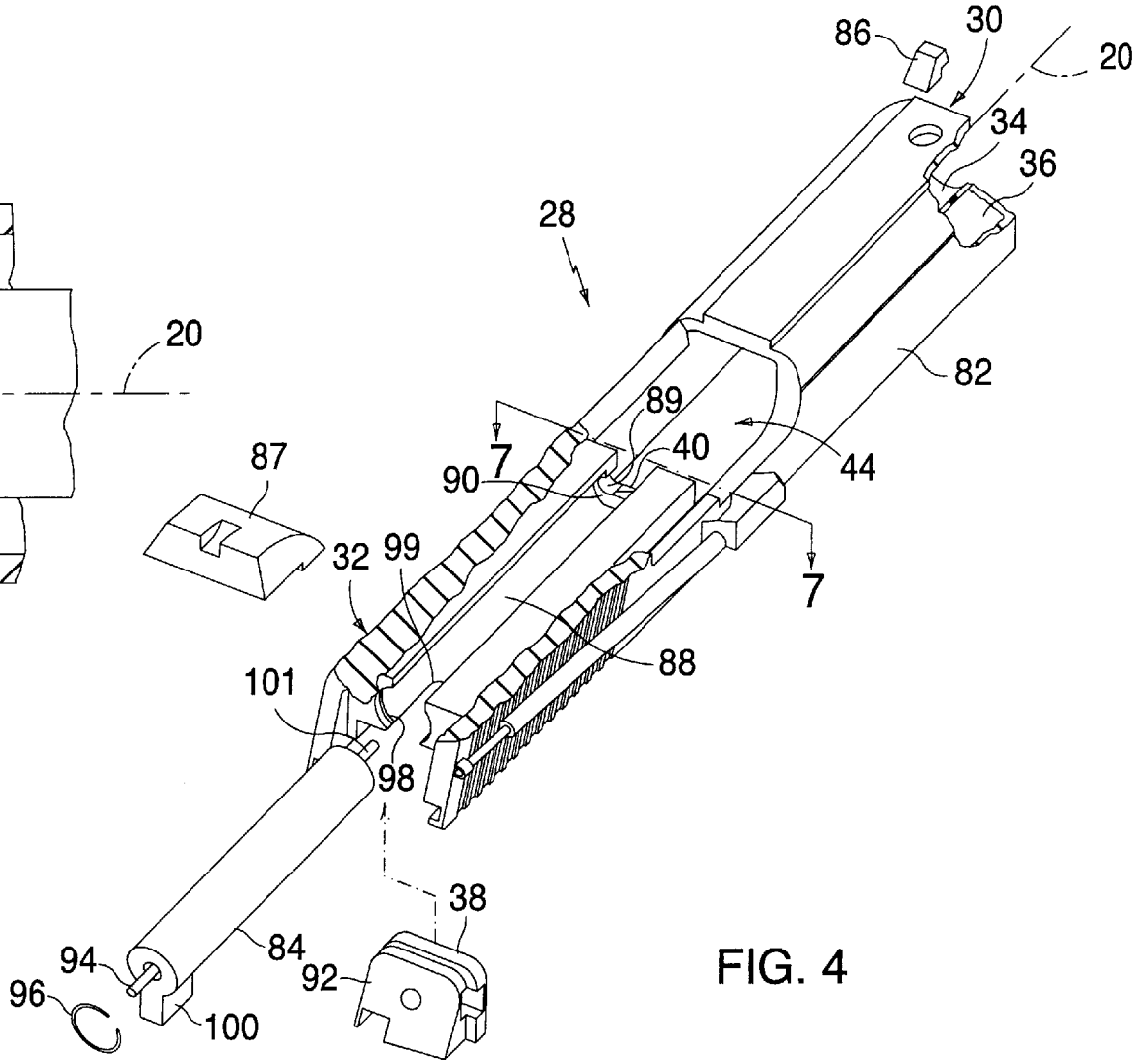
FIG. 4 is a slightly enlarged and exploded perspective view of the slide assembly of FIG. 3, showing a firing probe, retainer, and front and rear sights.
Figure 6:
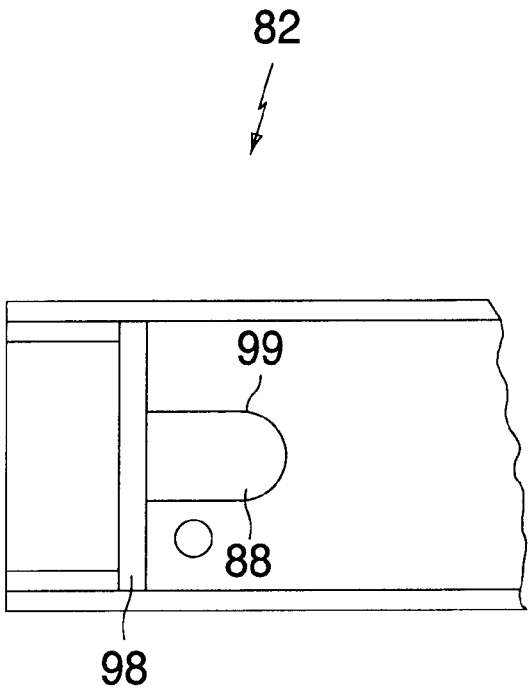
FIG. 6 is an enlarged bottom plan view of a rear end of the slide frame of FIG. 4.
Figure 5:
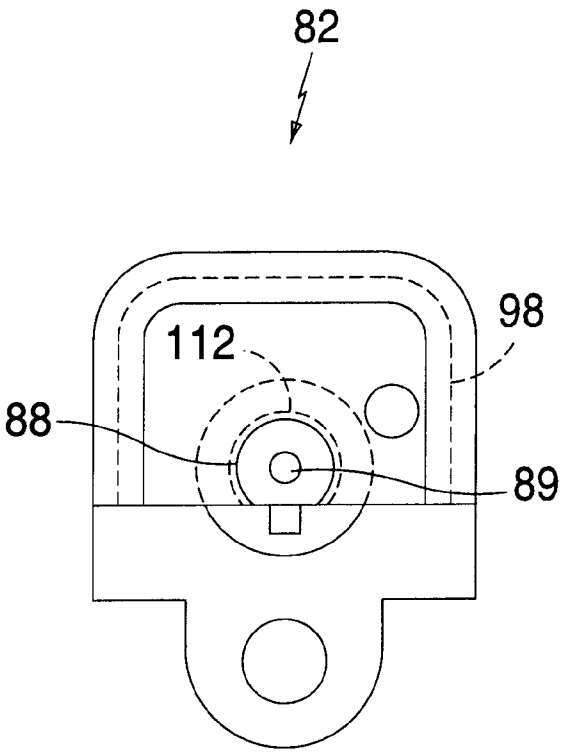
FIG. 5 is an enlarged end view of the slide assembly of FIG. 4.

Referring to FIGS. 4–6, the slide assembly 28 includes a steel slide frame 82, the retainer 38, a firing probe assembly 84, and conventional front and rear sights 86, 87. The slide frame 82 includes the breech face 40, an elongated, cylindrical firing probe bore 88, and the ejector port 44. The breech face 40 is oriented perpendicular to the firing axis 20 and includes a tip bore 89 which extends along the firing axis 20 through the breech face 40. The firing probe bore 88 is counterbored on the firing axis 20 from the aft end 32 of the slide frame 82 and forms an annular probe seat 90.

The aft end 32 of the slide frame 82 includes a conventional retainer channel 91 vertically below the frame 82. The retainer 38 has a plunger bore 92 defined generally on the firing axis 20 and adapted to slidably receive a spring-loaded end cap plunger 94 of the firing probe assembly 84. The firing probe assembly 84 is held securely within the firing probe bore 88 by a C-clip 96 engaged within a C-clip groove 98 of the slide frame 82. To facilitate assembly, a slight gap is maintained between the firing probe assembly 84 and the C-clip 96. The slide frame 82 has a slot 99, or relief, that is configured to receive a lower housing 100 of the probe assembly 84.

Figure 7:
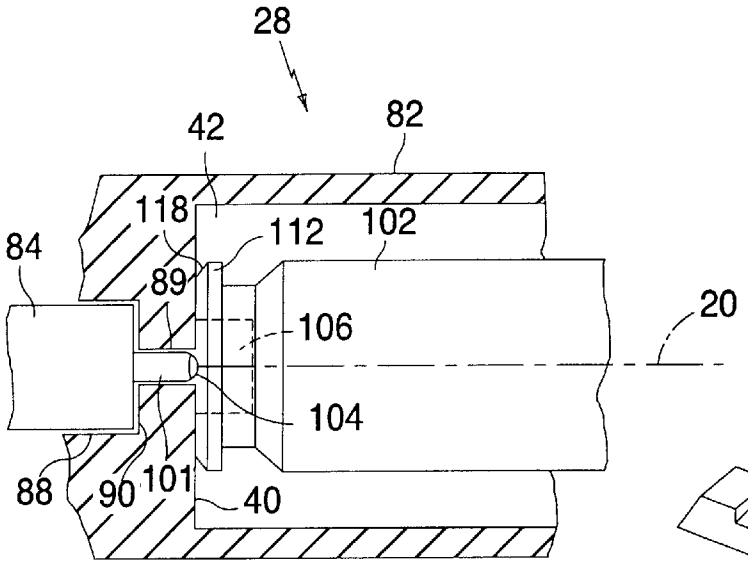
FIG. 7 is an enlarged sectional view of the slide assembly of FIG. 4, taken along lines 7—7.
Figure 8:
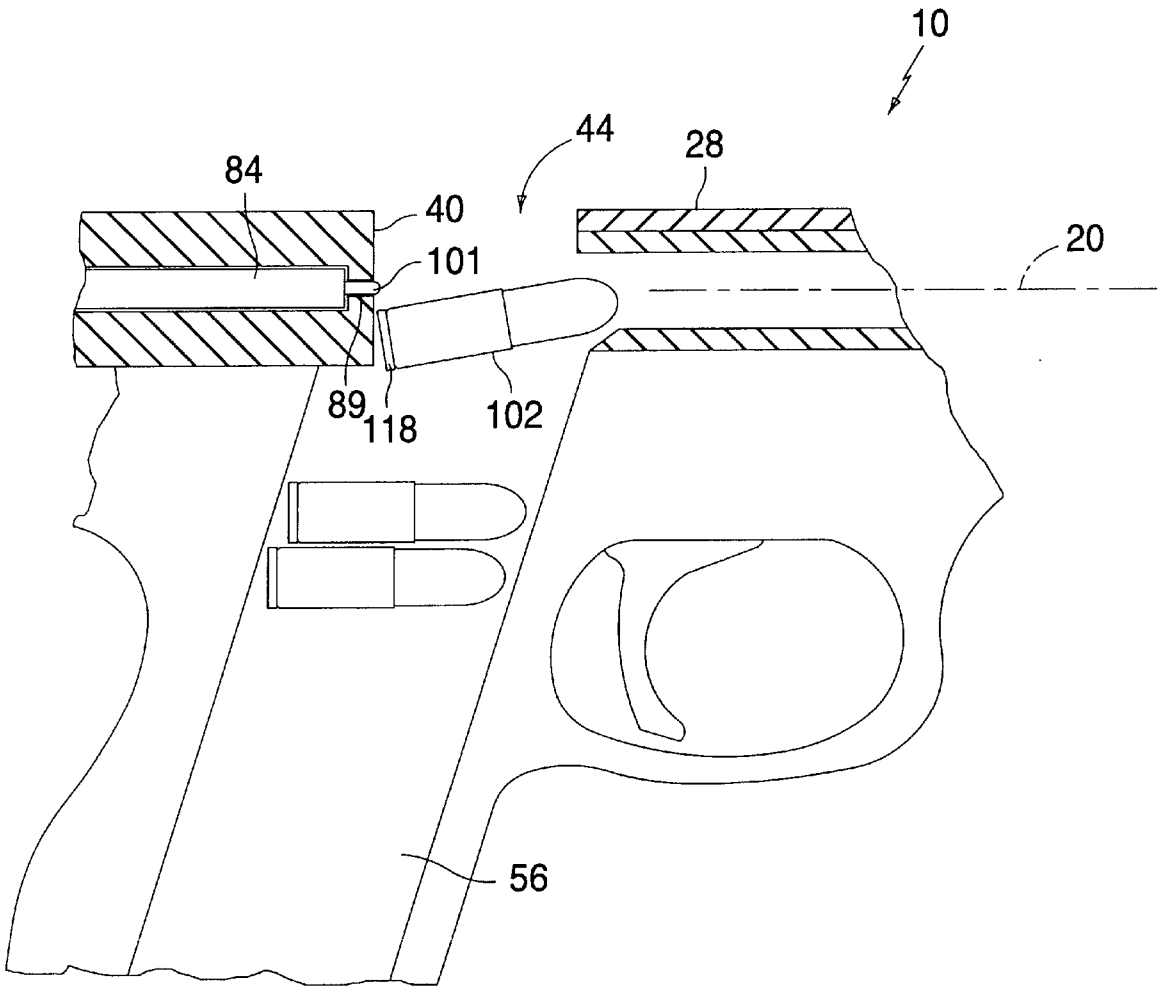
FIG. 8 is an enlarged schematical and generally bisected plan view of the pistol of FIG. 1, illustrating a cartridge moving toward camming engagement with the firing probe.

Referring to FIGS. 7–8, the firing probe assembly 84 includes a hardened-steel, spring-loaded probe tip 101 biased in the forward direction through the tip bore 89. The probe tip 101 is forced against a cartridge 102 with a maximum spring force of two pounds, (the spring configuration is discussed in detail below in connection with the firing probe assembly which electrically engages, or contacts, the cartridge 102 captured against the breech face 40 in the firing chamber.) The spring force enables the probe tip 101 and cartridge 102 to rub together during loading and unloading in such a manner as to cause wiping or self-cleaning thereby enhancing electrical contact properties.

Because the probe tip 101 is meant to conduct electricity only to the cartridge 102, and the breech face 40 is metallic, the probe tip 101 is coated with a ceramic material to electrically-insulate itself from the slide frame 82. Only a distal portion 104 is left uncoated so that electrical continuity is maintained between the cartridge 102 and firing probe assembly 84. The distal tip portion 104 has a radius of approximately 0.020 inches and extends beyond the breech face 40 by a distance of approximately 0.040 inches when the tip 101 is in its firing position. This ensures that there will be positive electrical contact between the firing probe tip 101 cartridge 102 produced by the aforementioned spring force.

The slide embodiments of the assembly contemplate use of a cartridge 102 fitted with a non-impact primer 106 such as that developed by Remington Arms Company and referred to as the Conductive Primer Mix described in U.S. Pat. No. 5,646,367. The primer 106 is imbedded within, and concentrically aligned with, the cartridge 102, and is designed to detonate when an electrical signal of a predetermined voltage is applied to it. An end cap 112 forms a contact surface that is slightly recessed within the end of the cartridge 102 and forms a dimple which receives the distal portion 104 of the probe tip 101.

The cartridge 102 is fed into the firing chamber in a direction that is substantially perpendicular to the firing axis 20 when the slide assembly 28 is drawn back rearwardly, so as to position the ejector port 44 above the magazine 56. In a camming action, a beveled edge 118 of the cartridge 102 contacts and depresses the spring-loaded probe tip 101 within the breech face 40. The probe tip 101 is then pushed forwardly toward its firing position, which is against and within the dimple of the cartridge primer 106. In their respective firing positions, the firing probe tip 101 and the cartridge 102 remain in contact with each other while in the firing chamber 42.

The aforementioned camming action of cartridges into the firing chamber 42 requires the firing probe to be spring-loaded. If the probe 101 was not spring-loaded, it could not retract within the slide frame 82, and the edge 118 of the cartridge 102 would jam against the firing probe 101 and the cartridge would fail to chamber. Spring-loading the firing probe also avoids having to configure the slide assembly and/or firing apparatus with mechanical or manual means of engaging the loaded cartridge.

As is common with firearms, normal use leaves contaminants, including lubricants, metal cartridge shavings, and by-products of burnt gunpowder and primer, deposited over much of the firearm. These contaminants can accumulate on the probe tip 101 and/or the breech face 40, and possibly cause a short in the electrical path between the firing probe assembly 84 to the cartridge 102. Care must be exercised to prevent excessive wear of the ceramic coating from the probe tip 101 after extended use, which may increase the risk of a short circuit.

Figure 10:
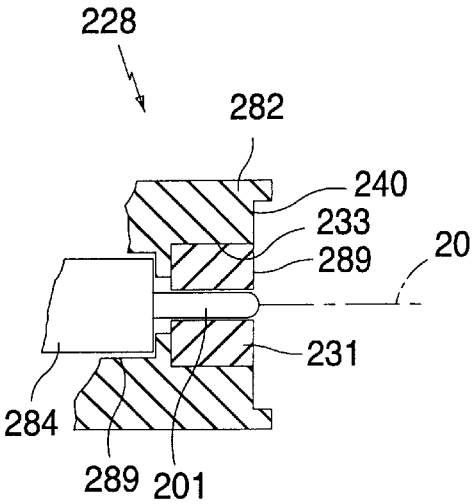
FIG. 10 is an enlarged sectional view of the slide assembly of FIG. 9, taken along the lines 10—10.
Figure 9:
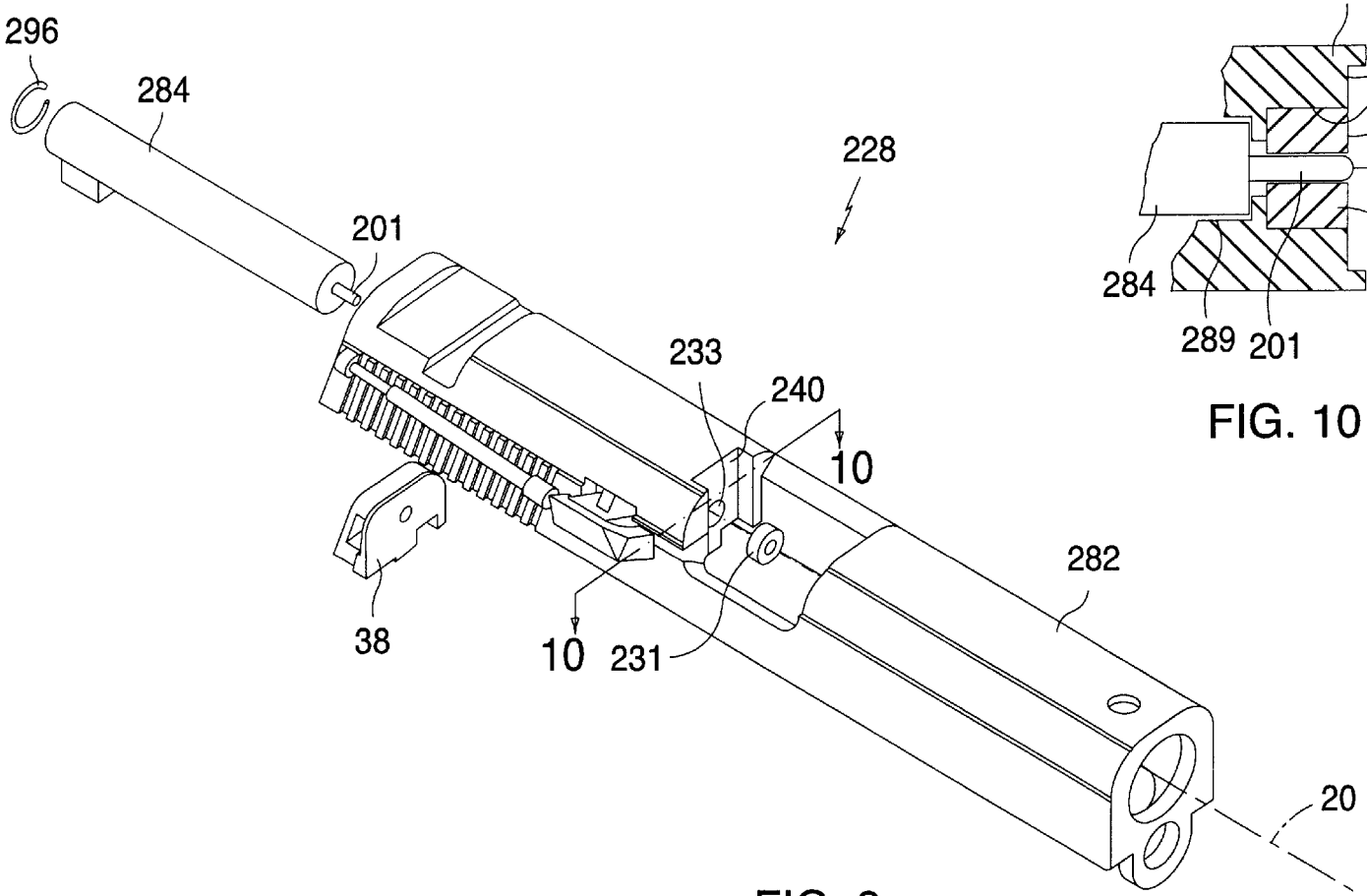
FIG. 9 is a frontal perspective view of a second embodiment of the slide assembly of FIG. 1, showing a breech face bushing removed from the slide frame.

Referring to FIGS. 9–10, slide assembly 228 includes a slide frame 282 having a breech face 240 with a countersunk bushing bore 233 on the firing axis 20 which is configured to receive a ceramic, annular breech face bushing 231. The depth of the bushing bore 233 coincides with the axial thickness of the bushing 231 so as to produce a flush breech face 240 after assembly. The bushing 231 has a probe tip bore 289 on the firing axis 20 to slidably receive a probe tip 201 of a probe assembly 284. A C-clip 296 retains the probe assembly 284 within a probe bore 288 of the slide frame 282. The bushing bore 233 has an annular seat 235 with an inner diameter which is large enough to prevent contact between the probe tip 201 and the slide frame 282 during use.

Figure 11:
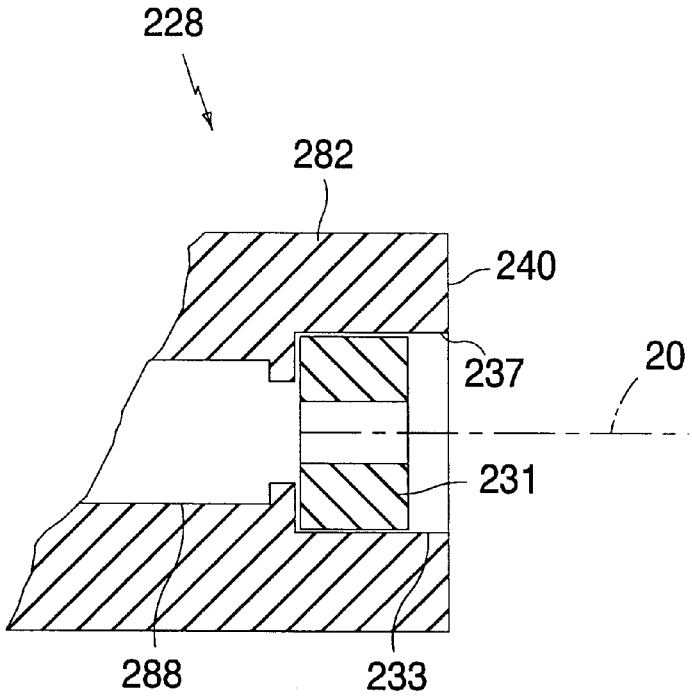
FIG. 11 is a view similar to that of FIG. 10, except shown with the breech face bushing recessed within a breech face.

One drawback with slide assembly 228 is that the annular bushing 231 and the breech face 240 must be aligned precisely so the bushing 231 is not recessed within, or protruding from, the breech face 240. If the bushing 231 is recessed within the breech face after assembly, as shown in exaggerated form in FIG. 11, an edge 237 of the bushing bore 233 can shave material from the rim of a cartridge during loading and/or ejection, gradually accumulating deposits over time which may cause an electrical short circuit. The recession may also cause a "fail to extract" if the cartridge expands rearwardly when fired and is forced, or deformed, into the recession.

Figure 12:
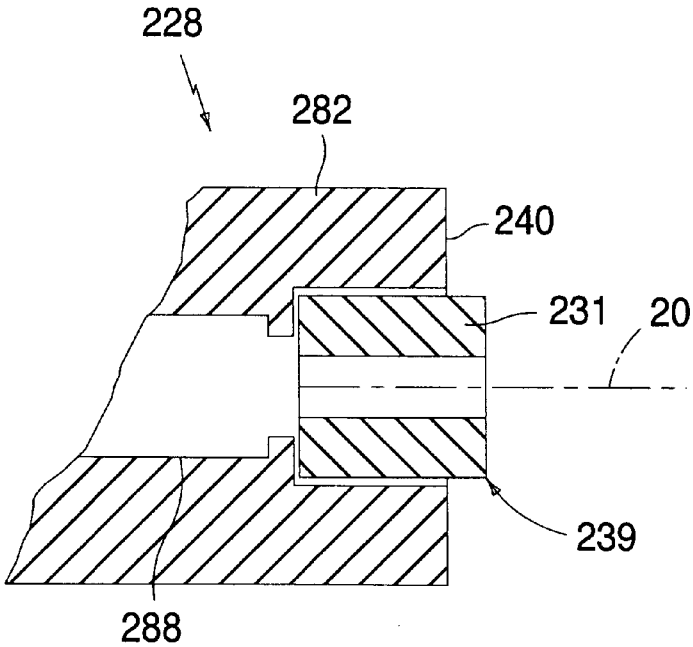
FIG. 12 is a view similar to that of FIG. 10, except shown with the breech face bushing protruding from the breech face.

If the breech face bushing 231 protrudes beyond the breech face 240, after assembly, as shown in exaggerated form in FIG. 12, a cartridge may catch on a corner 239 during loading, and partially or completely jam in the firing chamber. In summary, achieving an acceptable fit between the breech face 240 and the breech face bushing 231 is a difficult and cumbersome task requiring expensive manufacturing procedures.

Figure 14:
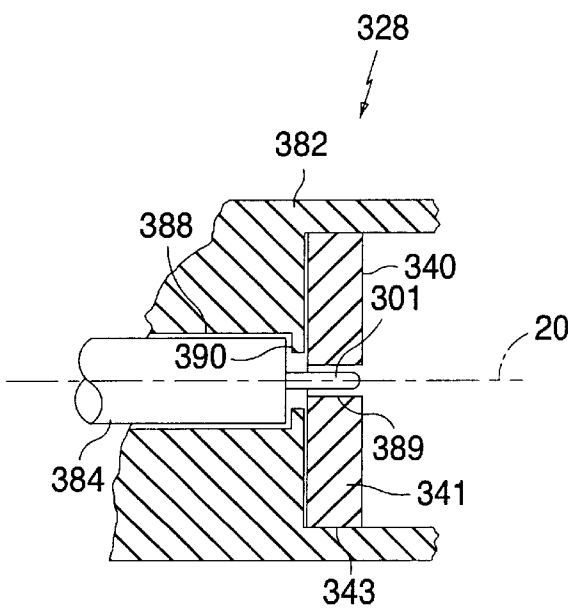
FIG. 14 is an assembled and enlarged broken-away cross-sectional view of the slide assembly of FIG. 13, taken along the lines 14—14 to illustrate installation of the breech face insert.
Figure 13:
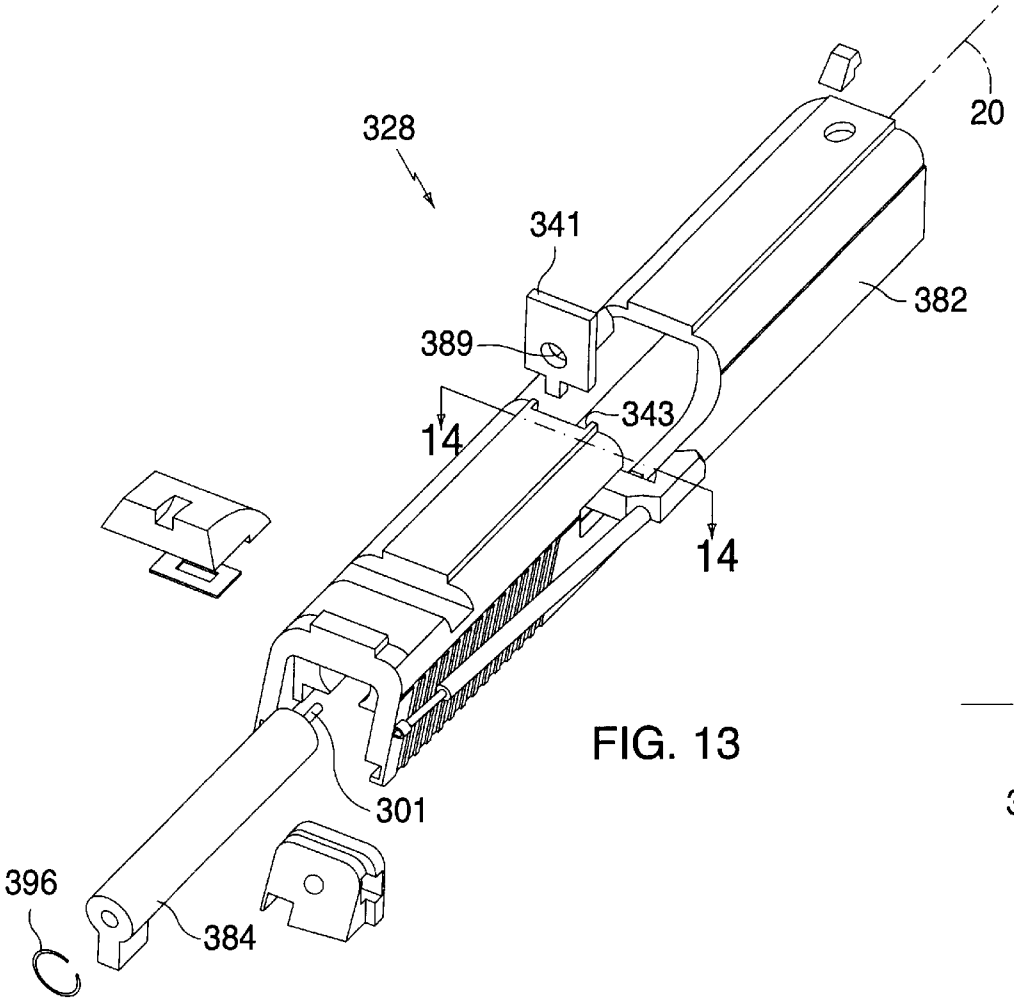
FIG. 13 is an exploded perspective rear view of a third embodiment of the slide assembly of FIG. 3, shown with a breech face insert removed from the slide frame.

Referring to FIGS. 13–14, the manufacturing problems discussed above in the area of the breech face are avoided with the slide assembly embodiment designated as numeral 328. A ceramic breech face insert 341 is press-fitted into a breech face channel 343 of a slide frame 382, and includes a breech face 340 and a probe tip bore 389 defined on the firing axis 20. The slide frame 382 has a firing probe bore 388 with an annular seat 390 that receives a firing probe assembly 384 and its steel, uncoated probe tip 301. A C-clip 396 retains the probe assembly 384 within the probe bore 388. The probe tip 301 does not require a ceramic coating because it is sized to pass through the annular seat 390 without making contact therewith. The probe tip 301 therefore extends through the ceramic breech face 340 to contact a loaded cartridge without any concern about electrical shorts between the probe tip 301 and slide frame 382. Because the breech face insert 341 is ceramic, however, attention must be directed to its fit within the breech face channel 343 to avoid cracking during installation and/or normal use.

Figures 15, 16, 17:
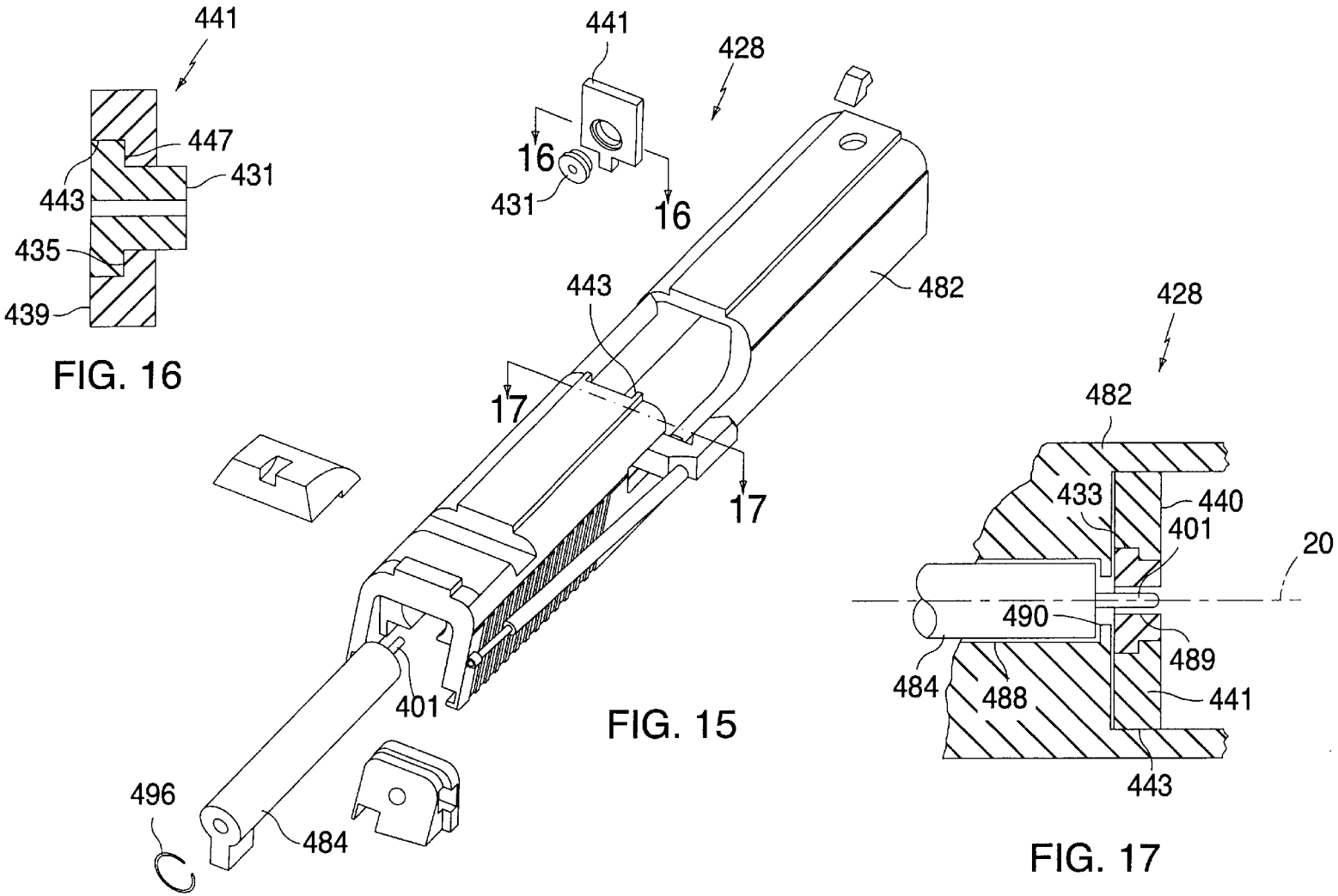
FIG. 15 is an exploded perspective rear view of a fourth embodiment of the slide assembly of FIG. 1, showing a breech face bushing and a breech face insert.
FIG. 16 is an assembled cross-sectional view of the breech face insert and breech face bushing of FIG. 15, shown prior to a final manufacturing step and installation in the slide frame.
FIG. 17 is an assembled cross-sectional view of the slide assembly of FIG. 15, taken along lines 17—17.

Referring to FIGS. 15–17, a slide assembly 428 combines design features of slide assemblies 228 and 328, including an annular, ceramic bushing 431 pressed into a steel breech face insert 441. The insert 441 and bushing 431 are assembled to form a breech face 440 and are then pressed into a breech face channel 443 of a slide frame 482. A bushing bore 433 is countersunk into a rear face 439 of the insert 441 to form an annular seat 435 on the firing axis 20 which receives and supports a complementary shoulder 447 of the bushing 431. The bushing 431 defines a probe tip bore 489 which slidably receives a probe tip 401 of a firing probe assembly 484. A C-clip 496 retains the firing probe assembly 484 against an annular seat 490 of a probe bore 488.

Preferably, the bushing 431 is installed into the breech face insert 441 so that it initially protrudes beyond the bushing 431, as seen in FIG. 16. The bushing 431 and insert 441 are then machined, to form a flat breech face 440 as seen in FIG. 17.

Figure 18:
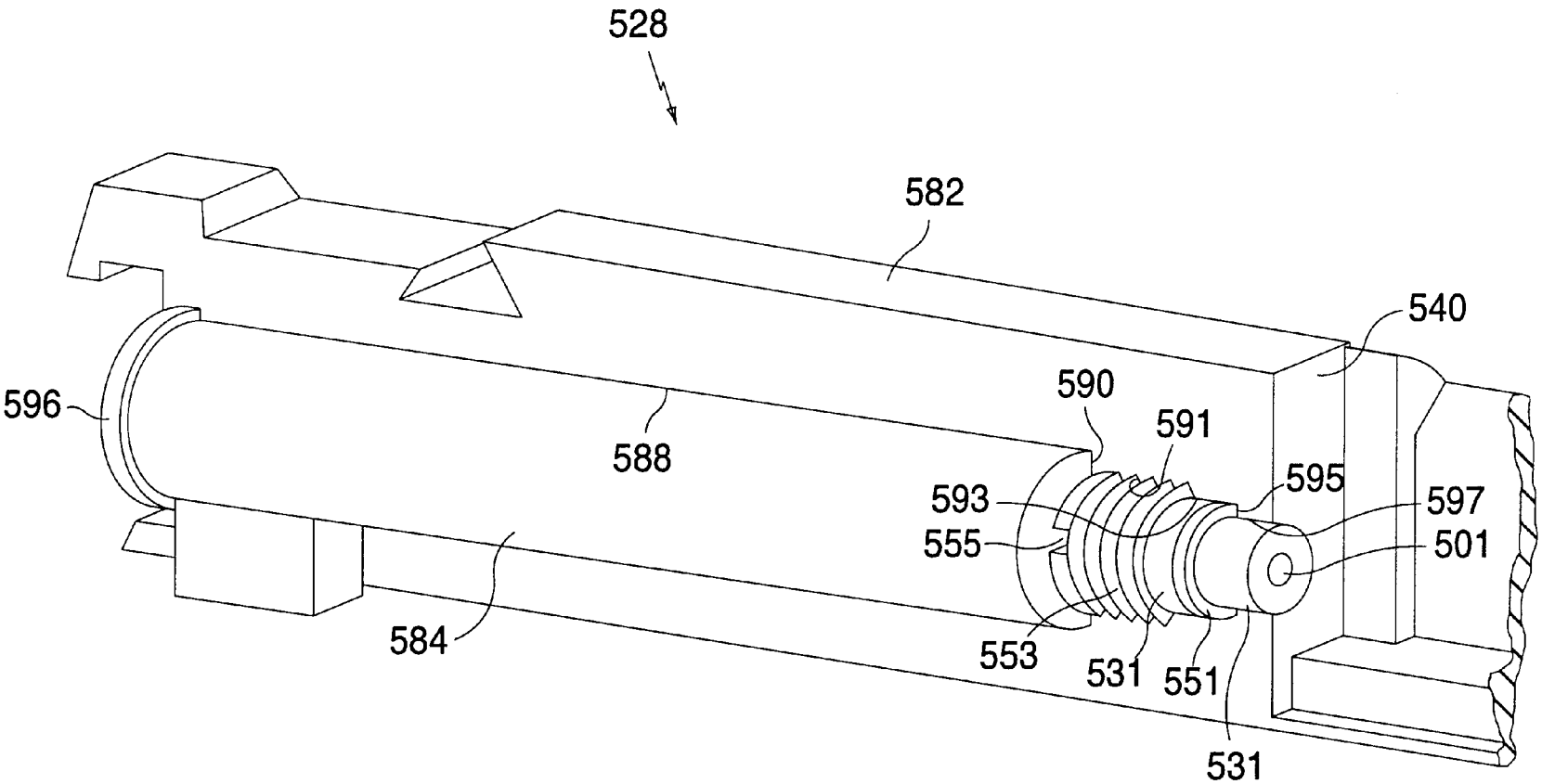
FIG. 18 is an enlarged frontal perspective view of a fifth embodiment of the slide assembly of FIG. 1, shown with its frame cutaway to illustrate a breech face bushing and bushing retainer.
Figure 19:
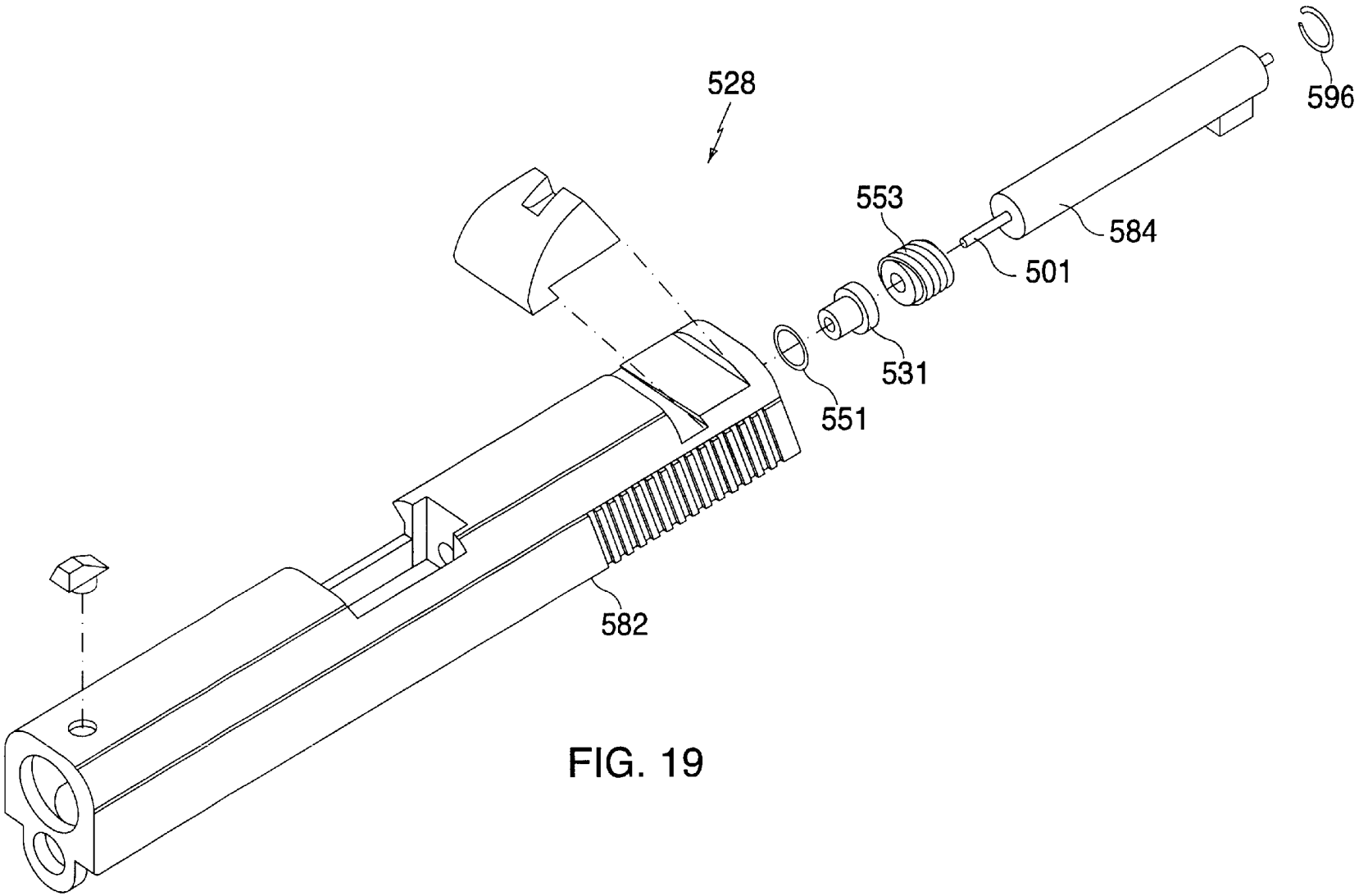
FIG. 19 is an exploded perspective view of the slide assembly of FIG. 18, shown slightly reduced in size.

Referring to FIGS. 18–19, a slide assembly 528 includes a slide frame 582 with a tip assembly bore configured to receive an annular breech bushing 531, a compression ring 551, a bushing retainer 553 and a firing probe assembly 584. A C-clip 596 retains the firing probe assembly 584 against an annular seat 590 of a firing probe bore 588. The breech bushing 531 and bushing retainer 553 each define a bore aligned on the firing axis 20 to slidably receive a firing probe tip 501 of the firing probe assembly 584.

The tip assembly bore is divided into three concentrically-aligned sections: a threaded first section 591 and cylindrical first and second sections 593, 595. The second section 593 has a larger diameter than the third section, thereby defining an annular seat 597. The breech bushing 531 has first and second axial sections which, respectively, fit snugly within the first and second bore sections 593, 595 and against the seat 597. The compression ring 551 is sized to fit over the second section of the breech bushing 531 prior to its insertion into the slide frame so as to cushion the bushing 531 against the annular seat 597.

The bushing retainer 553 includes a slot 555 on its rear face adapted for use with a screwdriver to tighten the retainer 553 into the slide frame 582. The compressive characteristic of the compression ring 551 allows the axial location of the breech bushing 531 to be precisely set with respect to the breech face 540. That is, when the bushing retainer 553 is threaded into the threaded first section 591 after the breech bushing 531 and compression ring 551 are installed, the bushing retainer 553 forces the breech bushing 531 against the compression ring 551 to align the bushing 531 with the breech face 540. In this manner, the compression ring 551 pre-loads the threads of the bushing retainer 553 and keeps the assembly from loosening.

The bushing retainer 553 is constructed of steel to withstand the recoil forces generated by cartridge firings. The compression ring 551 is made of a resilient material which resists the lubricants and contaminants typically encountered during normal use of a firearm. The breech bushing 531 is constructed of a ceramic material to provide the electrical insulation between the probe tip and the slide frame.

Figure 20:
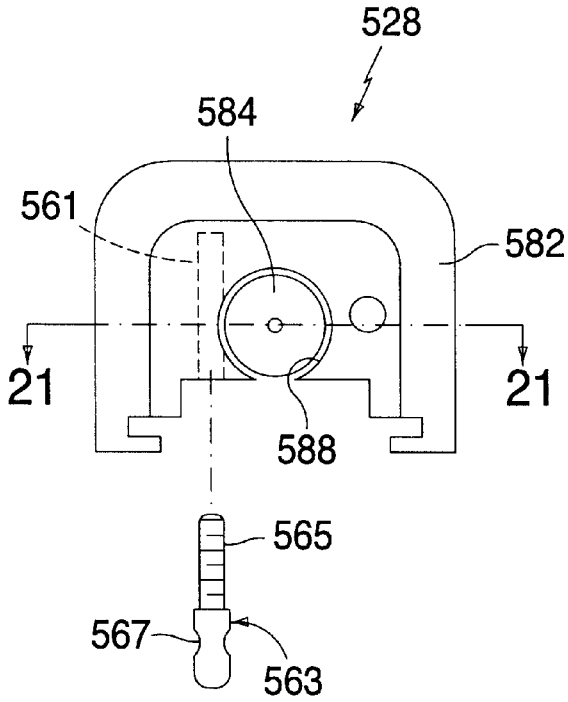
FIG. 20 is an exploded rear plan view of the slide assembly of FIG. 18.
Figure 21:
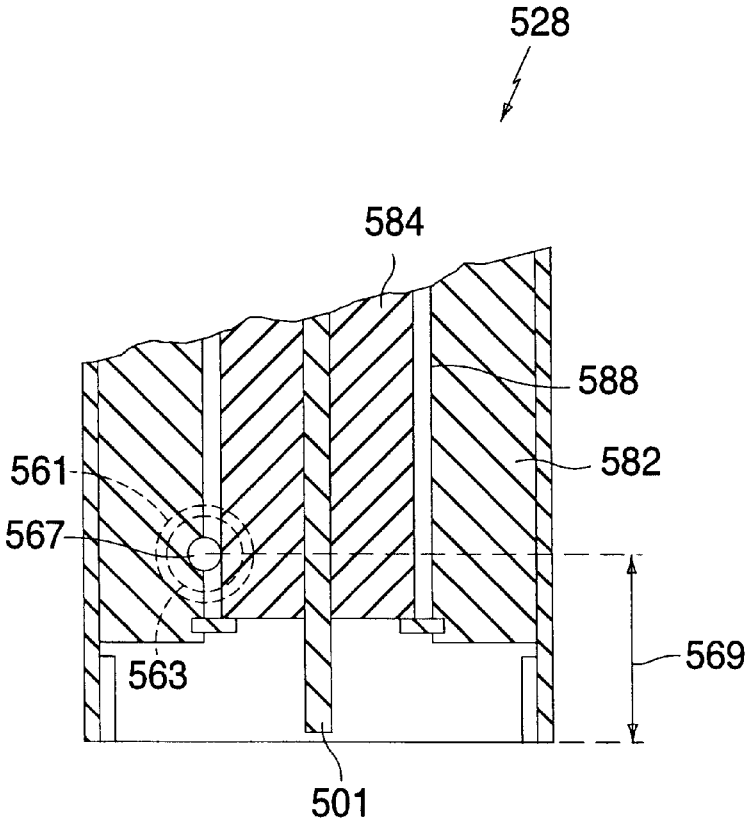
FIG. 21 is an enlarged cross-sectional view of the slide assembly of FIG. 20, taken along the lines 21—21.

Referring to FIGS. 20–21, a ground contact bore 561 is located in slide frame 582 to receive a spring-loaded ground contact 563 biased downwardly by a ground contact spring 565. The ground contact 563 has an engagement section 567 with a reduced cross-sectional area adapted to be engaged by the firing probe assembly 584 when inserted into its bore 588. The ground contact bore 561 is perpendicular to the firing probe bore 588 (and partially intersects the same) so that when the ground contact 563 is installed in the ground contact bore 561, and its engagement section 567 is aligned with the firing probe bore 588, the firing probe assembly 584 retains the ground contact 563 in the slide frame 582. The engagement section 567 has an axial length that leaves the contact 563 a slight amount of axial play in its bore 561. The ground contact bore 561 is located a distance 569 from the rear end of the slide frame 582 so that the ground contact 563 properly engages an associated terminal (discussed below) mounted on the backstrap module 50 when the slide frame 582 is in its firing position.

Figure 22:
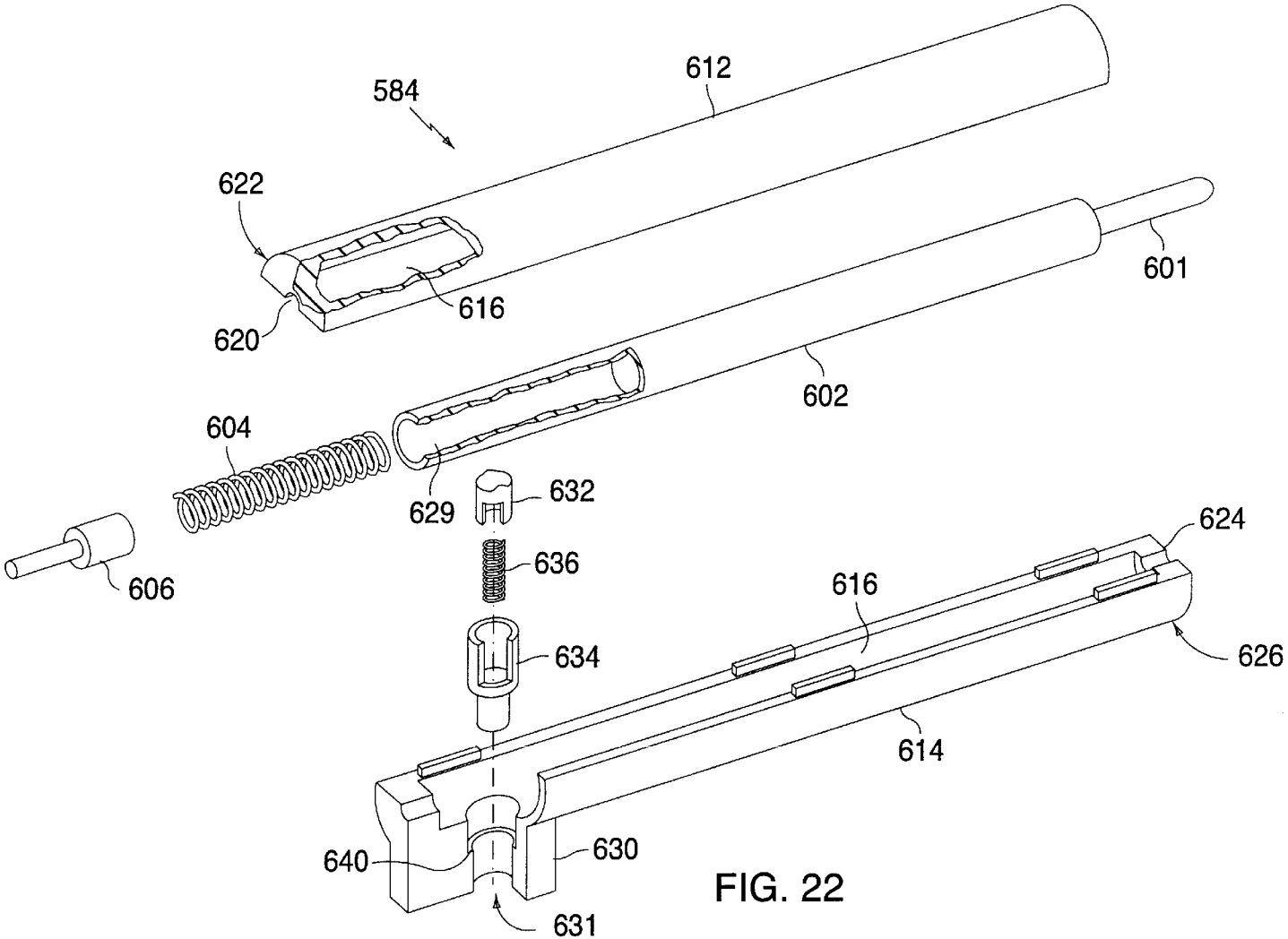
FIG. 22 is an enlarged, exploded and cut-away perspective view of the firing probe assembly of FIG. 4.
Figure 23:
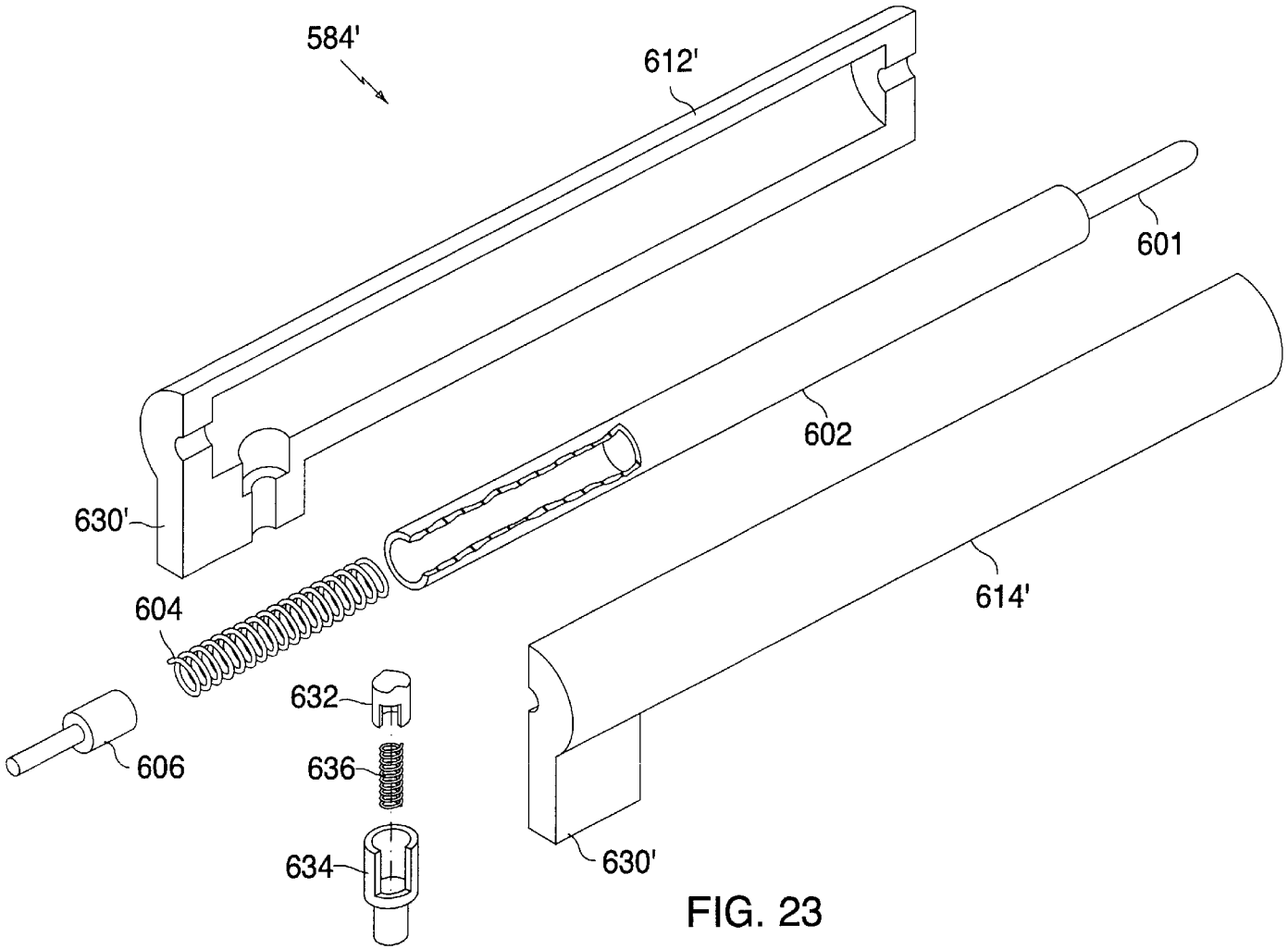
FIG. 23 is an enlarged, exploded and cut-away perspective view of a second embodiment of the firing probe shown in FIG. 4.

Referring to FIG. 22, the firing probe assembly 584 includes a stainless steel firing probe 602, a firing probe spring 604, and a non-conductive probe release pin 606 contained within a molded, two-piece, plastic firing probe housing assembled from the upper and lower housing halves 612, 614. The assembled housing halves define an internal, generally-cylindrical firing probe cavity 616, a release pin bore 620 through its rear end 622, and a probe tip bore 624 through its front end 626.

Figure 24:
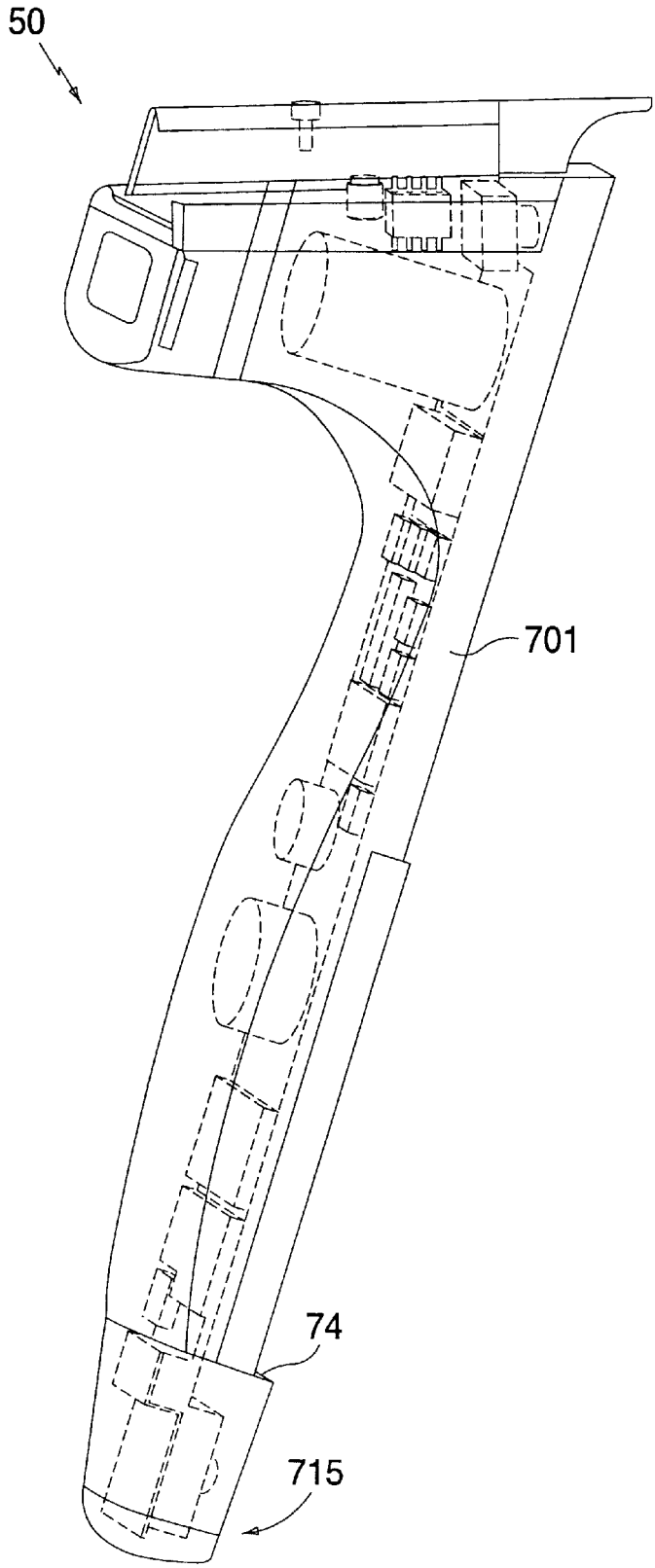
FIG. 24 is a schematical perspective view of the backstrap module of FIG. 2, shown with an array of electronic components mounted to a rigid circuitboard secured within a two-piece module housing.
Figure 25:
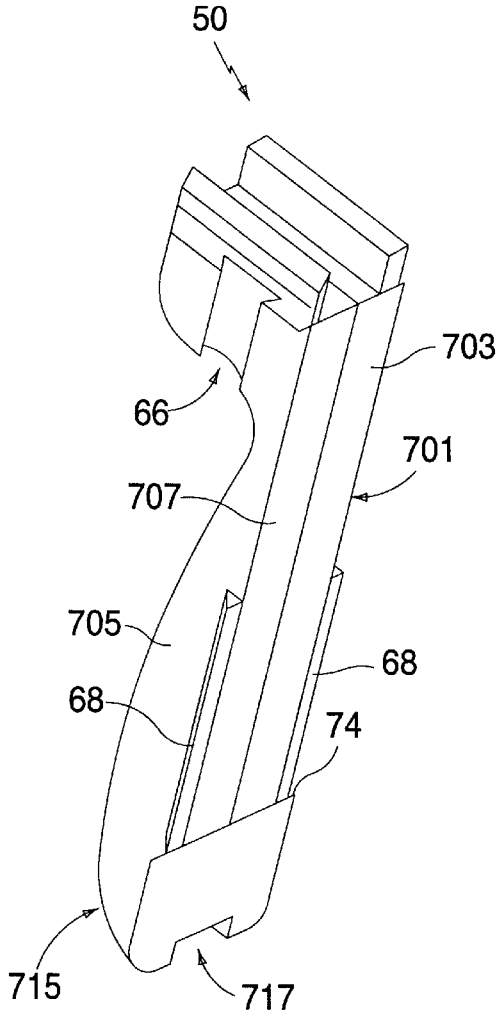
FIG. 25 is a frontal perspective view of the backstrap module of FIG. 24, shown reduced in size.
Figure 26:
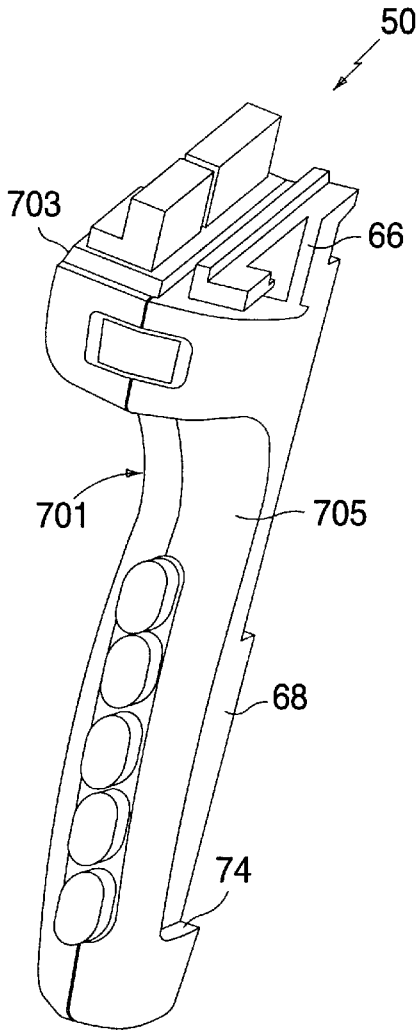
FIG. 26 is a rear perspective view of the backstrap module of FIG. 25.

Referring to FIGS. 24–26, the backstrap module 50 is configured to mount and protect the electronic components in pistol 10 and includes a two-piece protective housing 701 with left and right housing halves 703, 705 preferably made from injection-molded plastic. The lower dovetails 68 and stops 74 are located on a front side 707 of the housing 701. The housing 701 has a bottom end 715 configured with a downwardly-facing contact pad 717 which cooperates with the magazine 56 shown in FIG. 2 to conduct electrical power to the backstrap module 50.

Figure 27:
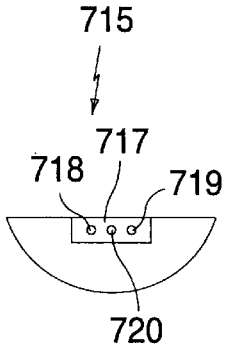
FIG. 27 is a slightly enlarged bottom plan view of the backstrap module of FIG. 26.

Referring to FIG. 27, the contact pad 717 includes three separate electrical terminals 718, 719, 720 that engage associated contacts on the magazine described in further detail below. Contacts 718, 719 are battery terminals, and contact 720 is a terminal which can be linked to a conventional external control module (not shown) for interrogating and/or changing information stored within the backstrap module. It should be understood that the configuration of the contact 720 can be changed to accommodate any appropriate type of external control module. For instance, the contact 720 may be one configured to accommodate the well-known Dallas MicroLAN protocol.

Figure 28:
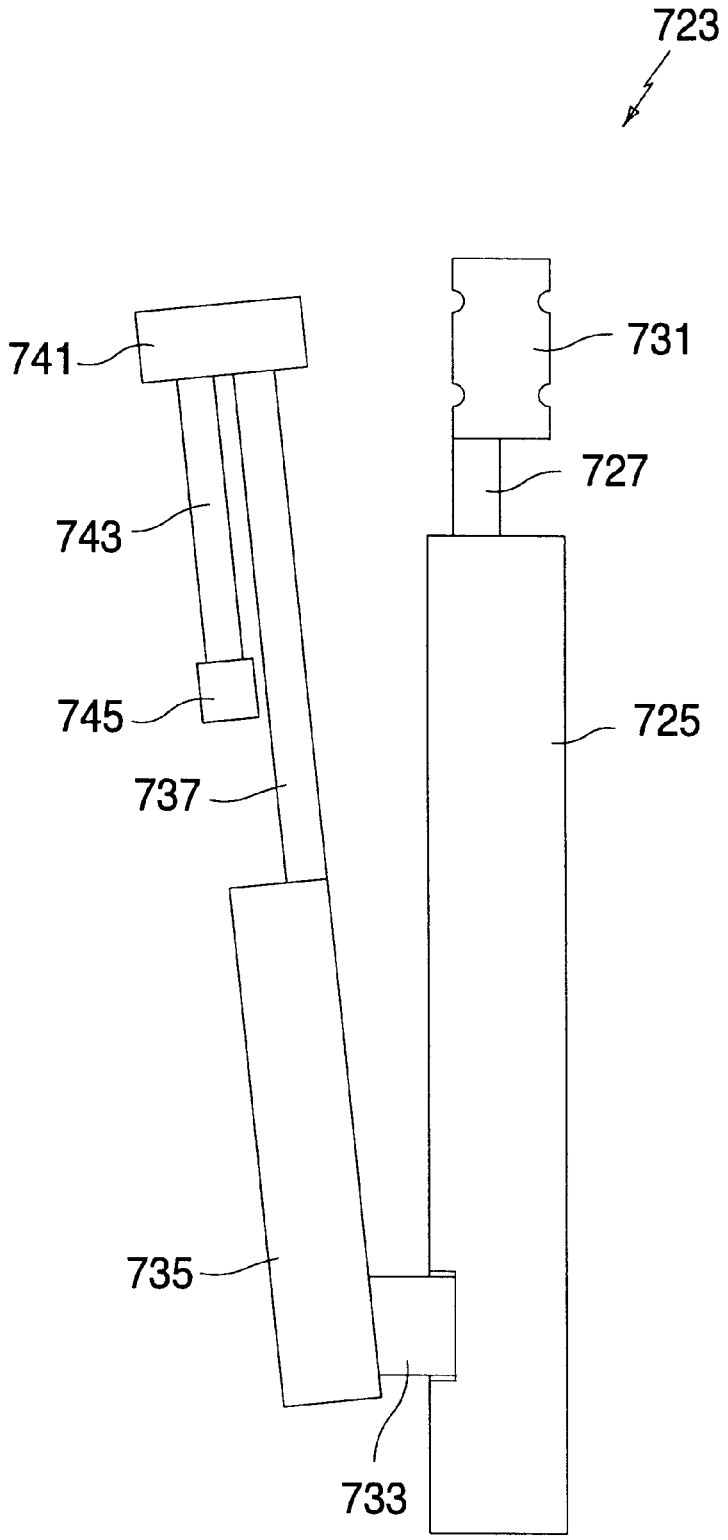
FIG. 28 is a schematic plan view of one embodiment of the rigid circuitboard of FIG. 24, shown without the electronic components and prior to installation in the module housing.
Figure 29:
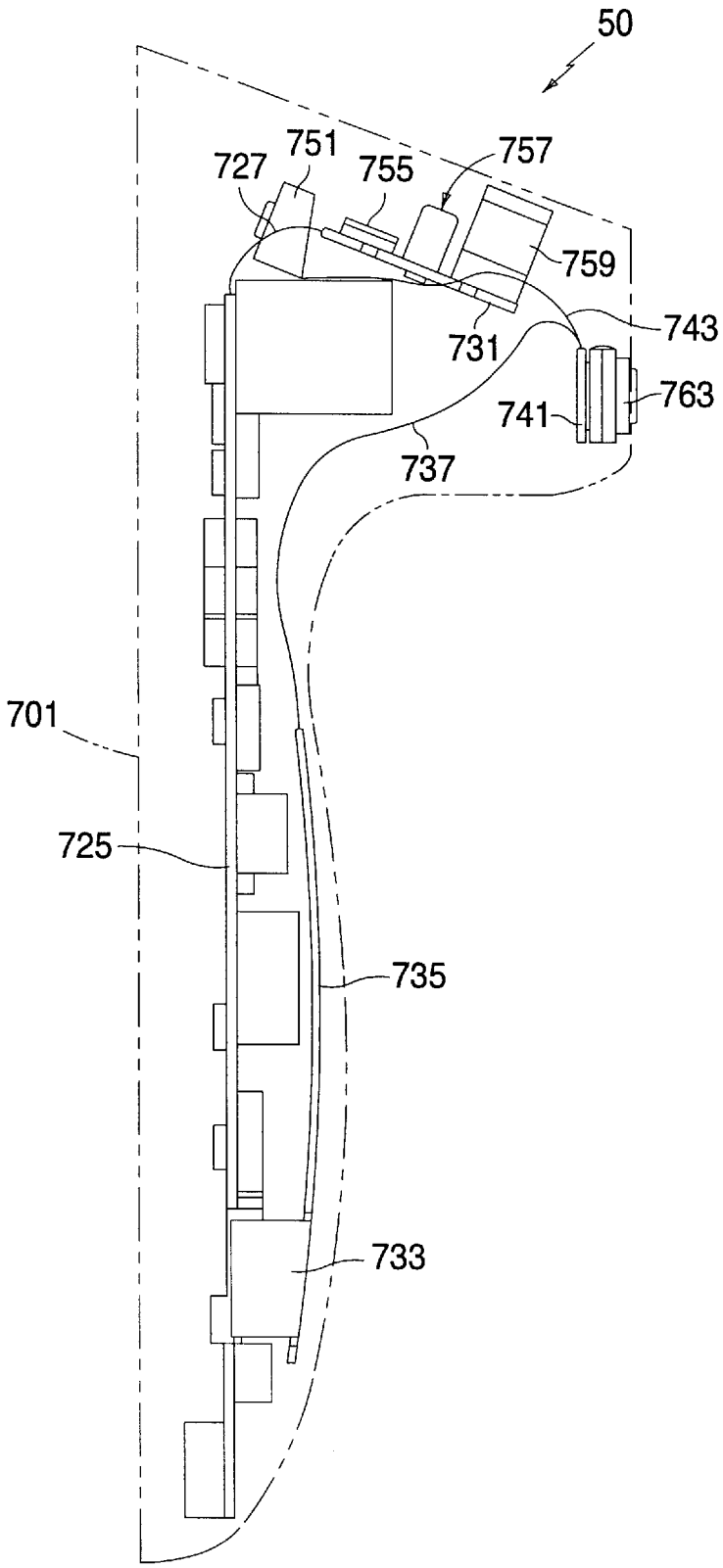
FIG. 29 is an enlarged schematic elevational view of the backstrap module of FIG. 24, shown from the left side and the module housing shown in phantom.

Referring to FIGS. 28–29, a circuitboard arrangement 723 is configured for mounting within the housing 701 to organize a majority of the electronic components, and is configured generally to accommodate well known surface mounting and/or post mounting techniques used for arranging electronic components thereon. Selected portions of the circuitboard arrangement 723 are flexible so the entire arrangement can be manipulated into a specific configuration or shape which efficiently utilizes the restricted space within the housing 701. The flexible portions are not separate components of the arrangement, but merely portions of the circuitboard which are embedded within a flexible rather than rigid material.

A rigid main circuitboard section 725 serves as the mounting surface for an array of components collectively referred to as a circuit assembly 726. The circuit assembly 726 is divided into two collections of components, a security apparatus and a firing apparatus, each of which has distinct and separate functions in the overall operation of the pistol 10.

The security apparatus has the broadly defined function of authorizing the firing apparatus to produce the firing signal. Production of the firing signal is not authorized until the security apparatus receives input signals indicative of compliance with a plurality of operating parameters, including a properly entered personal identification number of firearm operator, a signal indicating the firearm is being held properly, redundant signals from the trigger indicating movement of the trigger to its firing position, and a "Round-in-Chamber" signal indicative of a properly-loaded ammunition cartridge. The Round-in-Chamber is discussed in the co-pending application entitled "A FIREARM HAVING AN INTELLIGENT CONTROLLER". Once each input signal is received in accordance with the requirements set forth below, circuitry within the security apparatus authorizes the firing apparatus to produce the firing signal and deliver the signal to the firing probe.

It should be understood that the security apparatus can be modified to include or exclude any of the operational parameters from the firearm authorizing protocol. Once each required operational parameter is received by the security apparatus, an output signal is produced and transmitted to the firing apparatus which is analogous to a trigger pull in a conventional, percussively detonated firearm.

The firing apparatus is adapted to receive either of two signals from the security apparatus, and produce an associated output signal. One type of signal from the security apparatus requires production of a Round-in-Chamber signal which directs the firing apparatus to produce and deliver the appropriate low-voltage signal to the firing probe. The Round-in-Chamber is discussed in the co-pending application entitled "A FIREARM HAVING AN INTELLIGENT CONTROLLER". The other type of signal from the security apparatus requires the firing apparatus to produce the firing signal. The firing signal is a 150-volt charge produced by a fly-back circuit in the firing apparatus which amplifies energy from the 3-volt battery mounted in the magazine. The firing signal is transmitted to the primer 106 of the cartridge 102 via the probe contact 634 and the firing probe 602.

A first flexible portion 727 extends between the main circuitboard section 725 and a first mountboard 731. A second flexible portion 733 extends between the main circuitboard section 725 and a keypad 735 (the back side of the keypad is shown in FIG. 26). A third flexible portion 737 extends between the keypad 735 and a liquid crystal display (LCD) mountboard 741. A fourth flexible portion 743 extends between the LCD mountboard 741 and a microswitch mountboard 745.

Referring to FIG. 29, the circuitboard arrangement 723 and its various flexible portions and mountboards are arranged so that certain components can be oriented properly in the backstrap module 50 with respect to the frame, the slide assembly, and/or the user. A magnetic sensor 755, a high-voltage terminal 757, and a ground contact terminal 759 are arranged adjacent each other and attached to the first mountboard 731 which faces upwardly and is oriented generally parallel to the firing axis 20 seen in FIGS. 1 and 2. The second flexible portion 733 is shown installed with a curve so that the surfaces of the keypad 735 and main circuitboard section 725 shown in FIG. 27 are in an opposed relationship to each other. When installed, the keypad 735 also assumes a curved shape which conforms with the contour of the backstrap module housing 701 (shown in phantom). As also seen in FIG. 28, the keypad 735 is a component integrated directly into the circuitboard arrangement 723. In other words, the keypad is actually a portion of the circuitboard arrangement 723 rather than a separate component attached to the circuitboard arrangement 723. Five manually-actuated, pressure sensitive dome switches 787 are arranged on the side of the keypad 735 facing rearwardly in the assembled pistol 10 so they can be actuated by the user in a manner described below.

An LCD 763 is mounted to the LCD mountboard 741, and faces generally rearwardly so as to be viewed easily by an operator holding the pistol 10 in its sighting position or similar attitude. A microswitch 751 is mounted to the microswitch mountboard 745 and the fourth flexible portion 743 is curved slightly to properly orient the microswitch 751 such that its actuation axis is generally parallel to the first mountboard 731. As discussed in detail below, this orientation of the microswitch allows it to smoothly interact with movement of the trigger.

Figure 30:
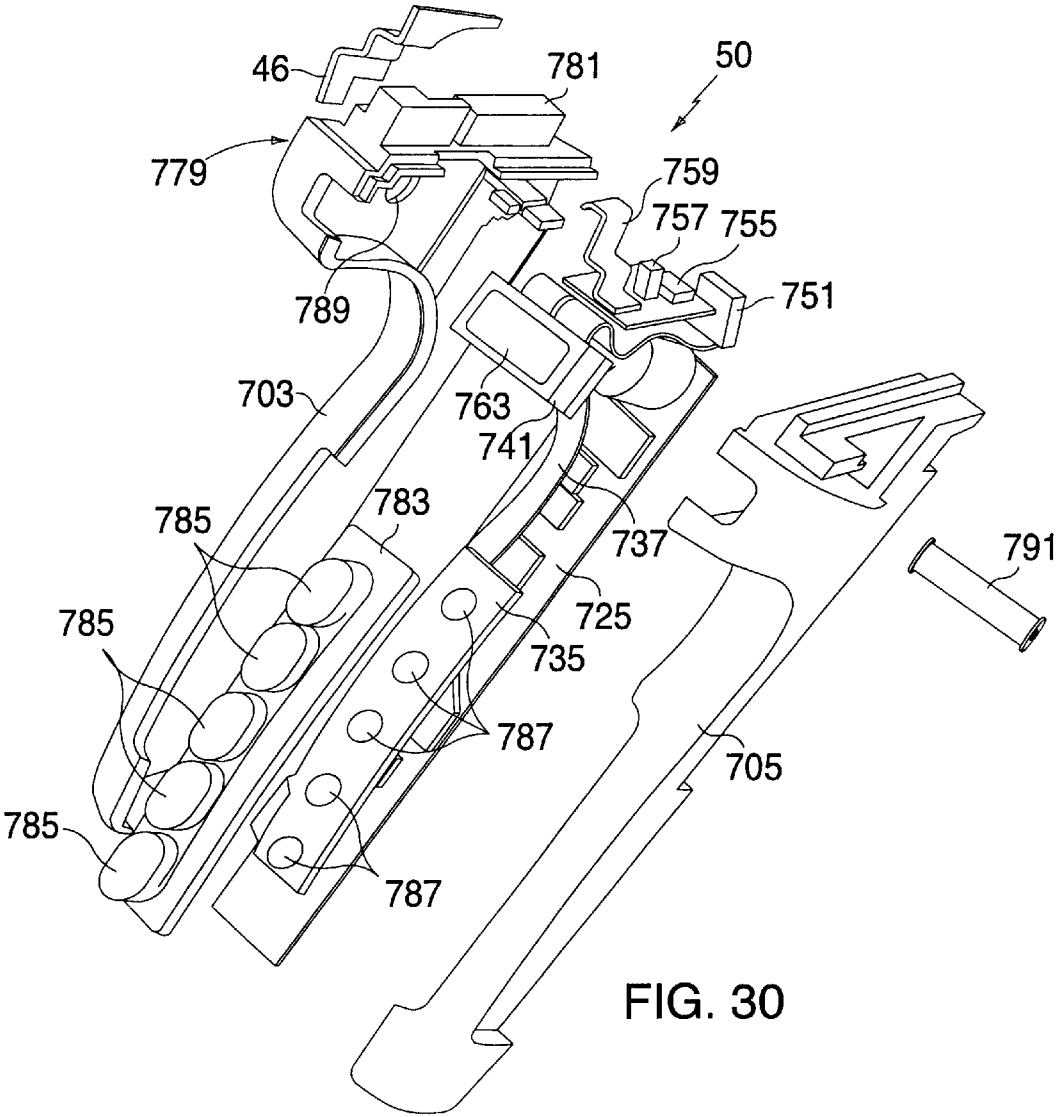
FIG. 30 is an exploded perspective view of the backstrap module of FIG. 26.

As seen in FIG. 30, the LCD 763 is secured symmetrically between the left and right module housing halves 703, 705, and is configured to receive information from the processor and communicate that information to the operator in the form of readable symbols or text. Examples of information provided for the user include: whether or not ammunition is loaded in the magazine; whether or not the firearm is in condition to be fired; and whether or not a safety mechanism is activated. Additional information which can be displayed includes the number of ammunition rounds in the magazine, battery condition, whether the firearm has been authorized or is locked, and whether the processor is active or inactive.

The ejector 46 has a known configuration that cooperates with the slide frame to eject spent cartridges. Unlike ejectors known in the art, ejector 46 is secured to the backstrap module 50 instead of the frame because the backstrap module comprises portions of the frame which were previously part of the frame. The ejector 46 is pressed generally laterally into engagement with an upper edge 779, and is secured in place by the dovetail 62 of the frame 12 when the pistol 10 is assembled.

The ground terminal 759 is wrapped over, and is supported by, a terminal rail 781 of the left module housing half 703. The ground terminal 759 is configured and positioned to engage the ground contact 563 when the slide assembly 528 is in its firing position. When the slide assembly 528 is moved rearwardly for any reason, electrical continuity is interrupted which prevents a firing signal ever being generated, much less sent to the firing probe.

A molded keypad cover 783 is secured within the pistolgrip 58 and includes five input buttons 785, each of which is configured and positioned to actuate an individual switch 787 of the keypad 735. The buttons 785 are located in the pistolgrip 58 of the assembled pistol 10 so that each can be depressed by the palm of the typical operator gripping the pistol 10 under normal operating conditions. The keypad cover 783 is manufactured from a soft, resilient material such as Silicon so that comfort of the pistolgrip 58 is not compromised.

A transverse mount hole 789 is defined through the module housing halves to receive a hollow mount rivet 791 once the housing halves are assembled. Once the module 50 is assembled and positioned properly on the frame 12, the pin 81 (shown in FIG. 2) is secured through the hollow mount rivet 791 to securely attach the backstrap module 50 to the pistol frame 12.

Figure 31:
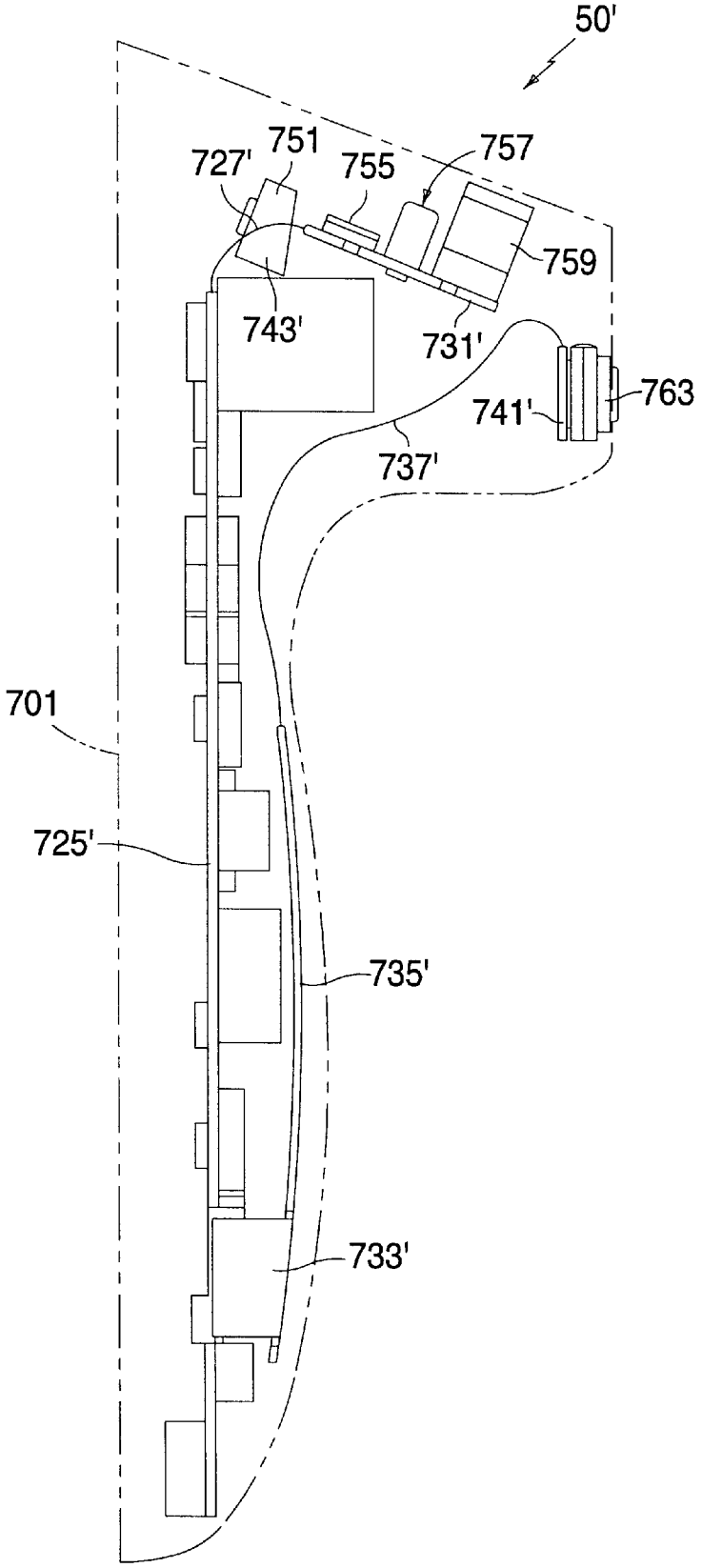
FIG. 31 is a view similar to that of FIG. 29, except shown enclosing a second embodiment of the rigid circuitboard.
Figure 32:
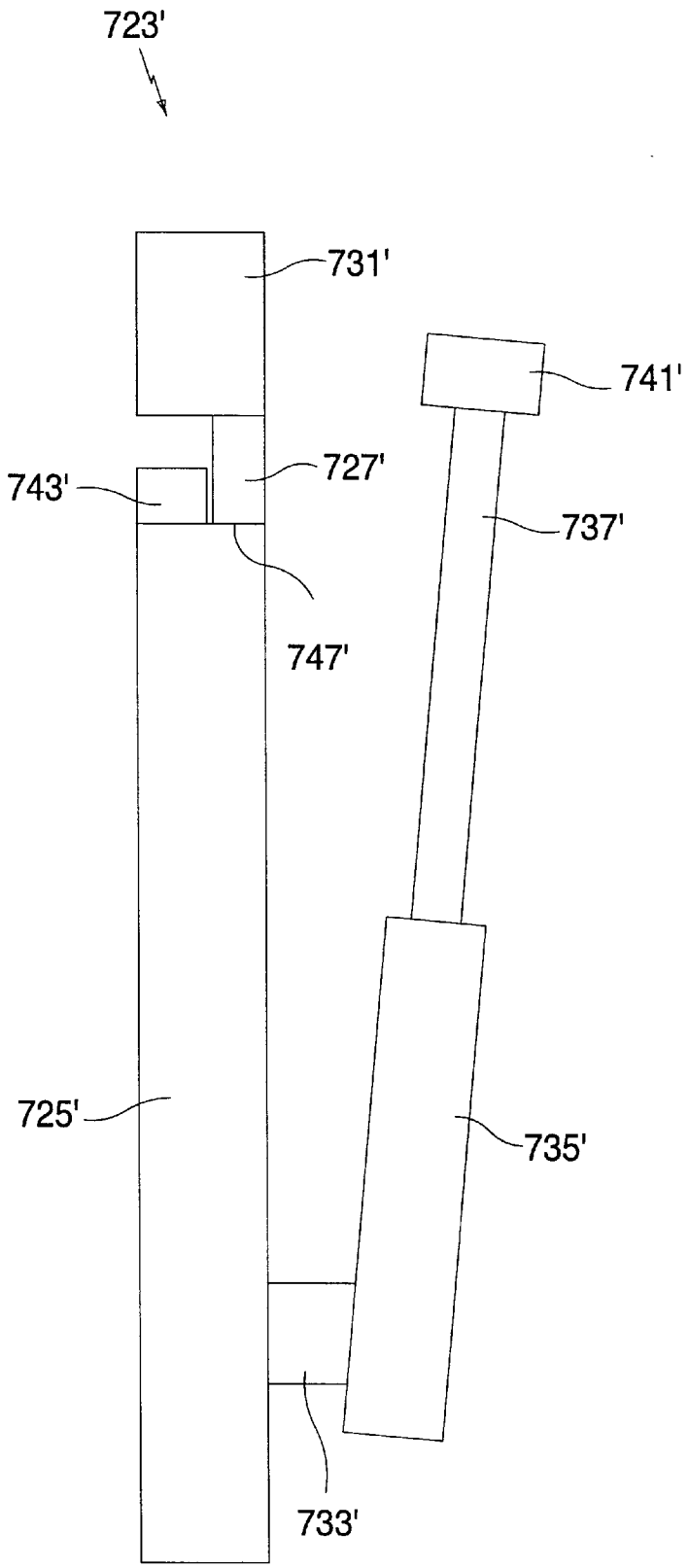
FIG. 32 is a plan view of the rigid circuitboard of FIG. 31, shown without electronic components mounted thereon and prior installation in the module housing.

Referring to FIGS. 31–32, a backstrap module 50' includes an alternate circuitboard arrangement 723' which is configured slightly differently from circuitboard arrangement 723. However, the same electronic and mechanical components are used in both modules 50 and 50' as backstrap module 50. The circuitboard arrangement 723' has a configuration that requires special care so that its flexible portions are not curved sharply to effect conductivity of the circuitboard. A first flexible portion 727' extends between a main circuitboard section 725' and a first mountboard 731', and a second flexible portion 733' extends between the main circuitboard section 725' and a keypad 735'. A third flexible portion 737' is configured to connect an LCD mountboard 741' to the keypad 735'. The most significant difference in arrangement 723' is its fourth flexible portion 743' connected directly to a top edge 747' of the main portion 725', instead of being connected to the LCD mountboard 741'. With this configuration, the fourth flexible portion 743' must be curved sharply (as seen in FIG. 31) to properly orient the microswitch 751 in the module 50'. Circuitboard arrangement 723, which does not present conductivity concerns, is preferred over arrangement 723'.

Figure 33:
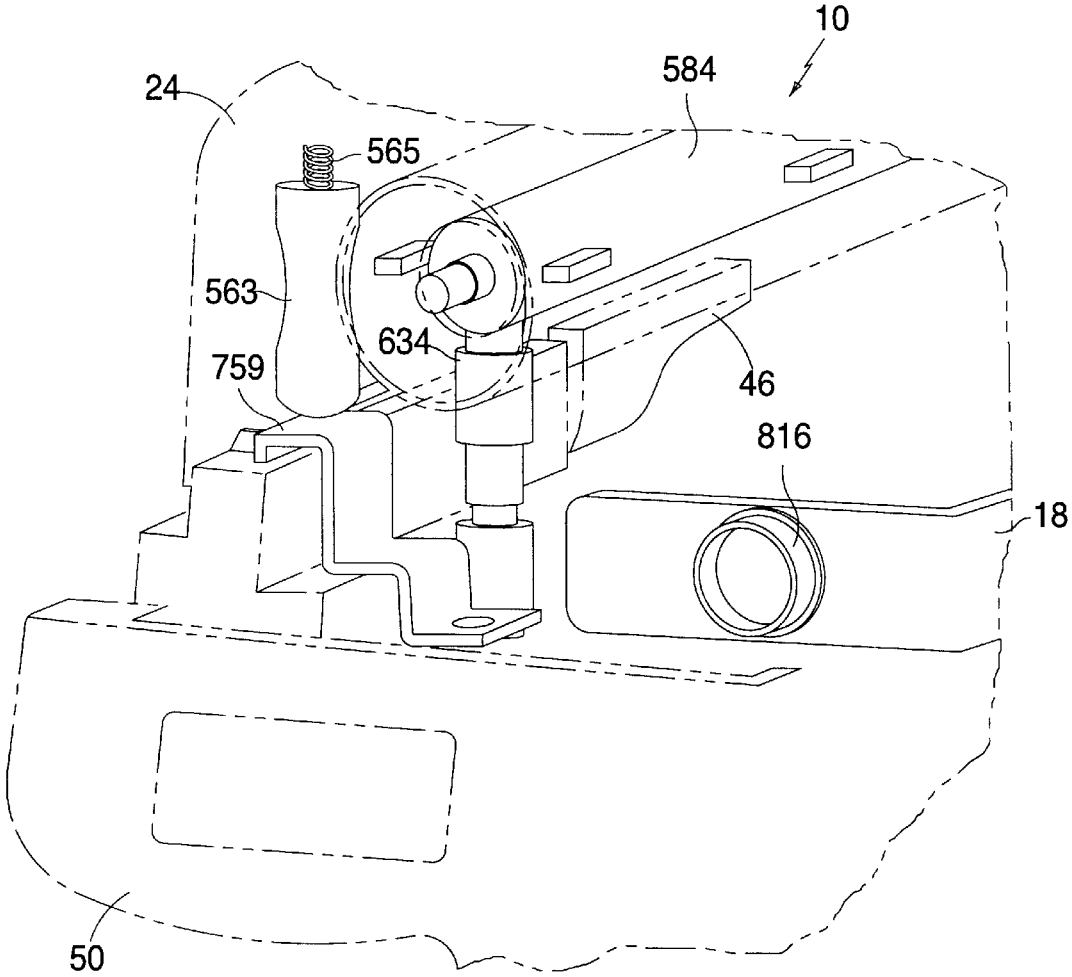
FIG. 33 is an enlarged rear perspective view of the pistol of FIG. 1, illustrating a ground contact engaged with a terminal of the backstrap module and a firing probe contact engaged with a probe terminal.
Figure 34:
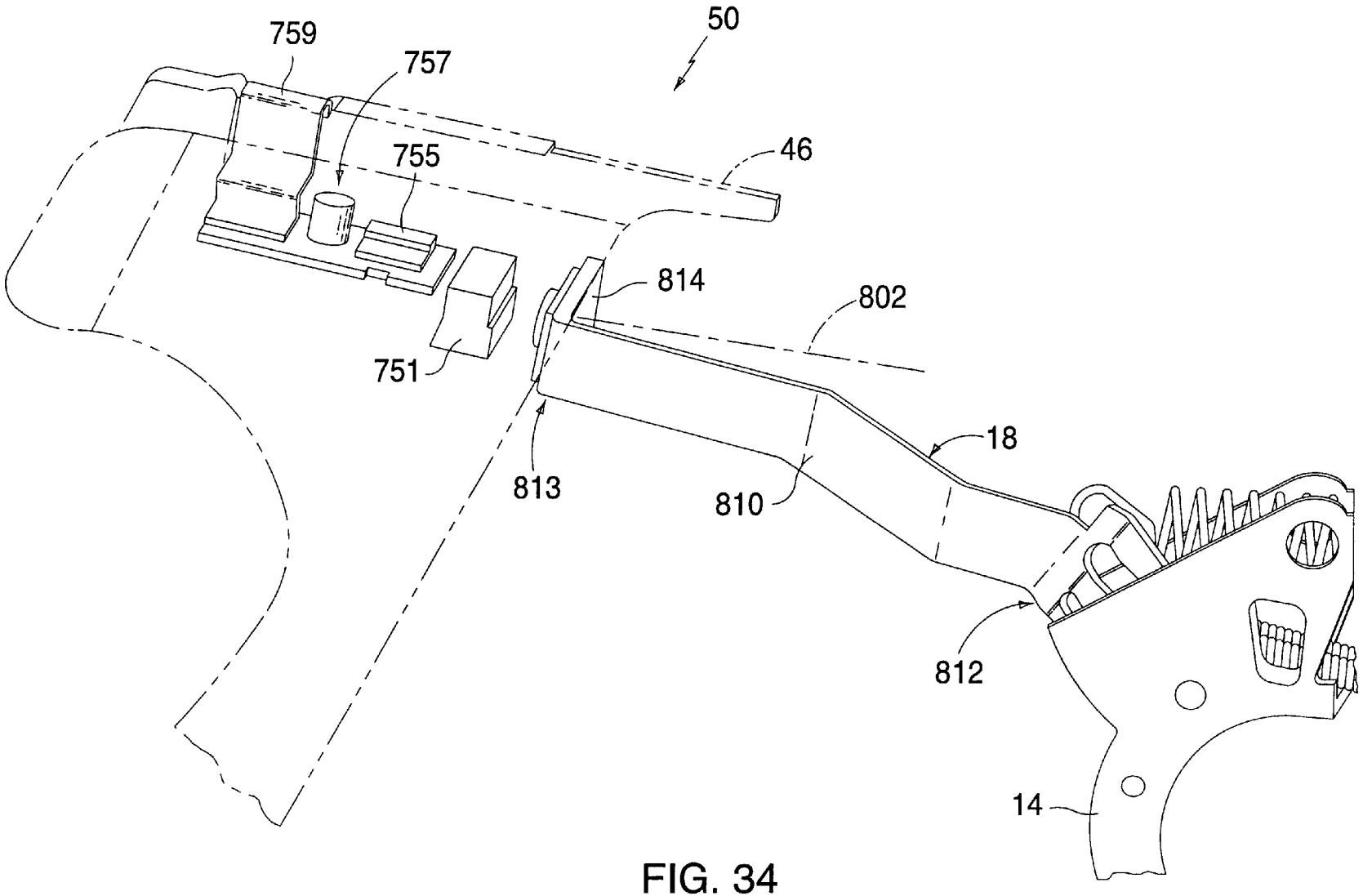
FIG. 34 is an enlarged perspective view of the backstrap module of FIG. 29, shown schematically in proximity with a trigger assembly.
Figure 35:
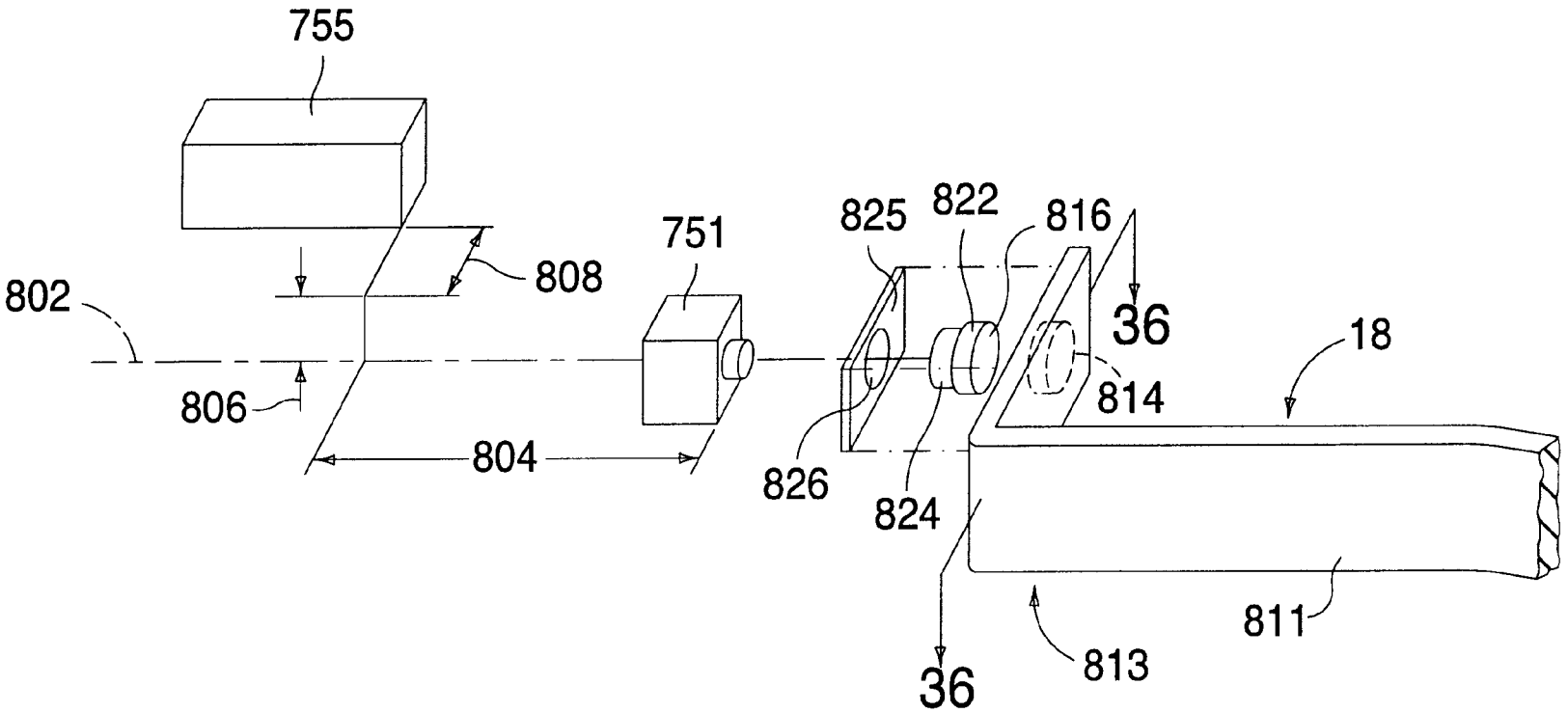
FIG. 35 is an exploded perspective view of the trigger assembly of FIG. 34, shown schematically and orthogonally with a microswitch and magnetic sensor.

Referring to FIGS. 33–35, the backstrap module 50 is configured to mount the magnetic sensor 755 and microswitch 751 so as to be actuated by the trigger bar 15. The microswitch 751 has an actuation axis indicated by the numeral 802, which preferably coincides generally with the actuation axis of the trigger bar 15. When the trigger is pulled or, according to the embodiment contemplated by the present invention, rotated about its pivot point, movement of the trigger is translated into generally axial movement of the trigger bar. The microswitch 751 is then depressed smoothly and efficiently by the trigger bar. The magnetic sensor 755 is positioned behind, above, and to the left of the microswitch 751 by distances, respective, of 0.262 inches, 0.056 inches and 0.131 inches, which are indicated by numerals 804, 806 and 808.

The flat trigger bar 15 includes an elongated middle section 810 situated between front and rear trigger bar ends 812, 813. The front end 812 is adapted to be pivotally connected to the trigger 14, and the rear end 813 is adjusted to actuate the microswitch 751 and magnetic sensor 755. The rear end 813 includes a rearward-facing blind bore 814 which receives a trigger magnet 816. The trigger magnet 816 has first and second axial portions 822, 824, the first portion 822 having a diameter larger than the second portion 824. A cover plate 825 defines a centrally-located aperture 826 having a diameter that is sized between the diameters of the first and second portions of the magnet 816. The cover plate 825 is placed over the magnet 816 and tack-welded to the trigger bar 15 to retain the magnet 816 securely within the blind bore 814.

Figure 36:
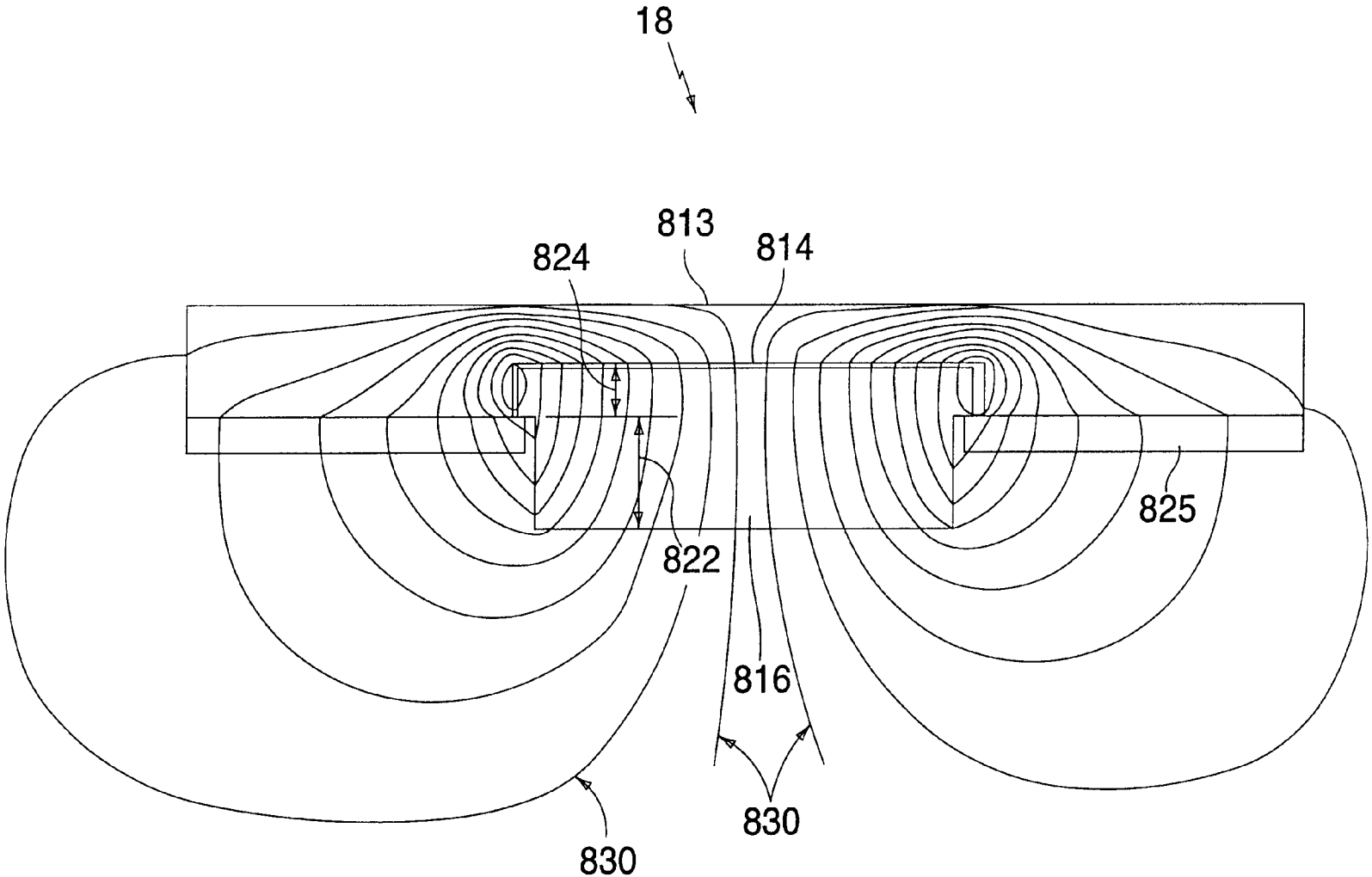
FIG. 36 is an assembled cross-sectional view of the trigger bar of FIG. 35, taken along lines 36—36 and illustrating lines of magnetic flux produced by the magnet.

Referring to FIG. 36, the trigger magnet 816 produces a magnetic flux 830 which must be carefully controlled to properly and consistently actuate the magnetic sensor 755. Prior to selecting a magnet for use in the pistol 10, the location and orientation of the magnetic sensor 755 in the backstrap module 50 was closely approximated. Due to space restraints, the sensor 755 is oriented in the backstrap module with its longitudinal axis (as opposed to its transverse axis) aligned with the actuation axis of the microswitch 751. As described above, the sensor is offset above, to the left, and behind the microswitch, and the offset distances were factors in selecting an appropriately-sized magnet. Hence, during experiments to study magnet flux and the sensitivity of the magnetic sensor, the only variables were the size of the magnet and the materials used to fabricate the trigger bar and cover plate.

Experiments revealed that an optimum magnetic flux 830 was achieved using a trigger bar fabricated from 400 series stainless steel, and a cover plate fabricated from 300 series stainless steel. If either of these materials was used simultaneously to fabricate both the cover plate and trigger bar, the magnetic flux 930 was either over- or under-attenuated.

Two sizes of a Neodymium magnet were tested: one with a longitudinal thickness of 0.072 inches; and the other with a longitudinal thickness of 0.087 inches. The 0.087-inch magnet produced a flux density at the sensor of 155 Gauss, which was considered too large, while the 0.072-inch magnet produced a preferred flux magnitude of 135 Gauss at the sensor. Flux from the 0.072-inch magnet could also be measured more consistently than with the 0.087-inch magnet, so the 0.072-inch magnet was selected for use in the preferred embodiment. The magnetic sensor (model AD004 Giant Magnetoresisitve (GMR) Sensor) and the magnet can be purchased from Nonvolatile Electronics, Inc. (NVE), of Eden Prairie, Minn.

As seen in FIG. 36, the magnetic flux 830 has an irregular pattern around the magnet 816 when the cover plate 825 and trigger bar 15 are fabricated, respectively, from 300 and 400 series stainless steel. In particular, the magnetic flux 830 extending in the forward direction is kept within the trigger bar 15, while the magnetic flux 830 extending in the rearward direction is shown passing outside the cover plate 825.

Figure 37:
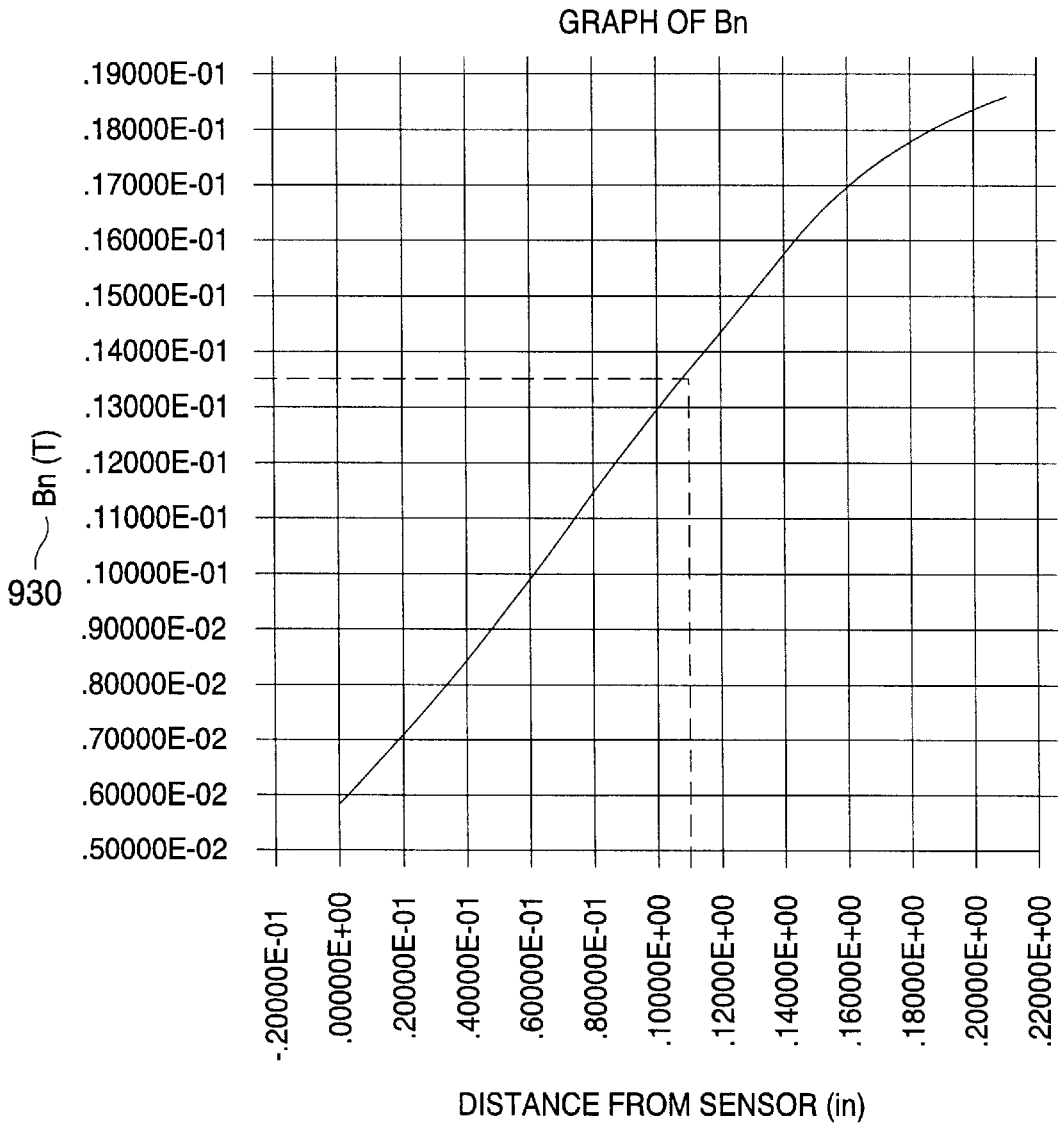
FIG. 37 is a graphical representation of the magnetic flux of FIG. 36 versus distance from the magnetic sensor.

Referring to FIG. 37, the magnet flux 830 is shown graphically as it varies with increased distance from the sensor. Flux levels are indicated on the vertical axis, and the distance of the magnet from the sensor is indicated on the horizontal axis. For example, with a distance of 0.110 inches between the sensor and the magnet 816, the sensor measures the flux to be approximately 0.13500E-01 (T). During experiments with different magnets, the distance of 0.110 inches was chosen as the point of comparison since that is approximately the distance which corresponds to the position of the magnet where the microswitch is actuated.

The magnetic sensor 755 provides the security apparatus with an analog actuation signal when a magnetic flux of a minimum value is detected. In the alternative, a sensor which produces a digital signal can be used in place of the analog sensor. The magnetic sensor is actuated approximately simultaneously as the microswitch.

Signals from the magnetic sensor and microswitch are also required by the security apparatus when the user attempts to fire the pistol in rapid succession. Once the magnetic sensor 755 has been actuated by movement of the trigger toward the firing position, the sensor must be reset by recovering the trigger at least to a predetermined "reset" position that requires at least partial trigger recovery. Therefore, successive pistol firings are only possible when the user recovers the trigger to the reset position. The intent is that the security apparatus will not communicate with the firing apparatus until the security apparatus receives the reset signal from the magnetic sensor and the microswitch has been released. It is contemplated that this programming arrangement can be changed according to specific requirements of use, such as by changing the distance that the trigger must be recovered to reset the magnetic sensor.

Figure 38:
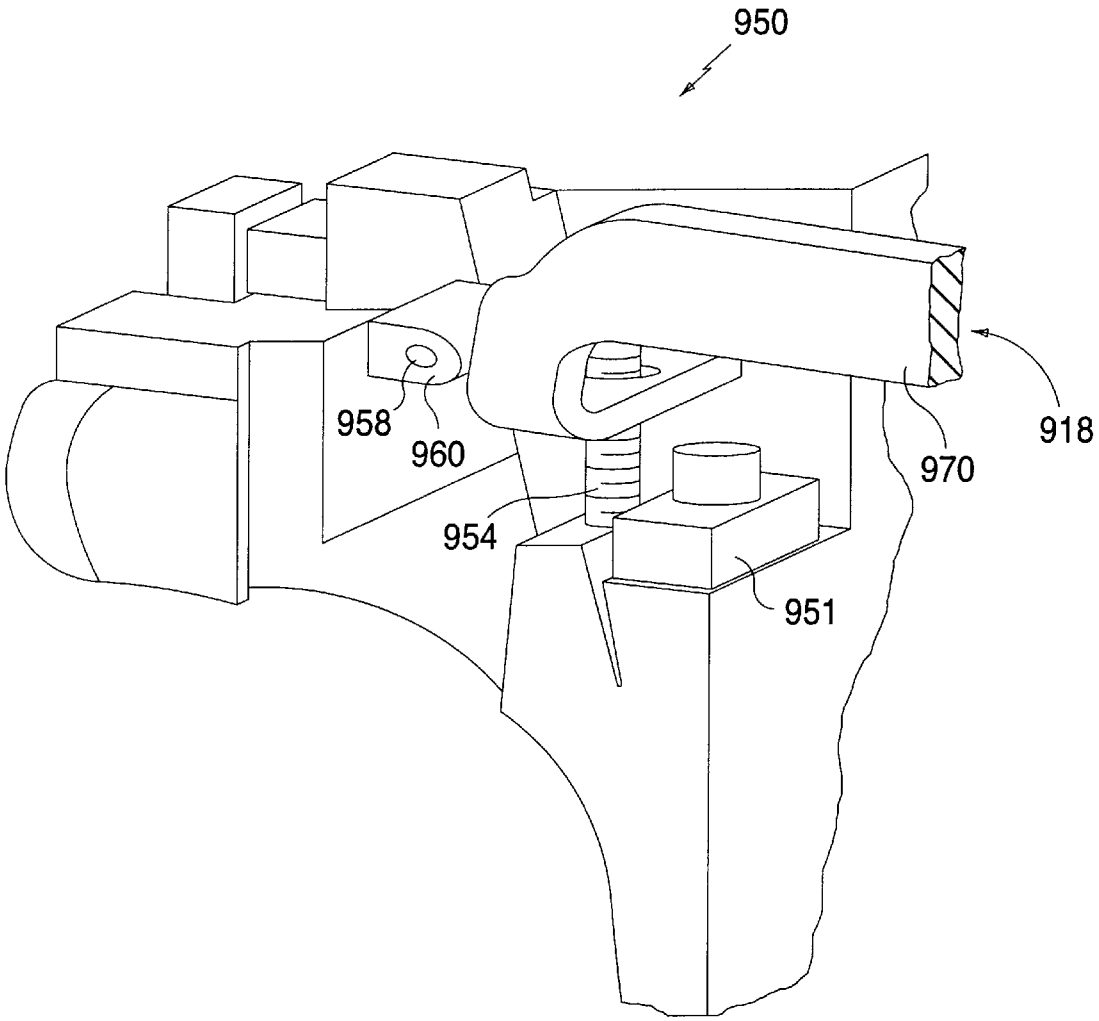
FIG. 38 is an enlarged cut-away perspective view of an alternate embodiment of the backstrap module of FIG. 2, shown with a trigger bar engaging a guide post and positioned against a cam.
Figure 39:
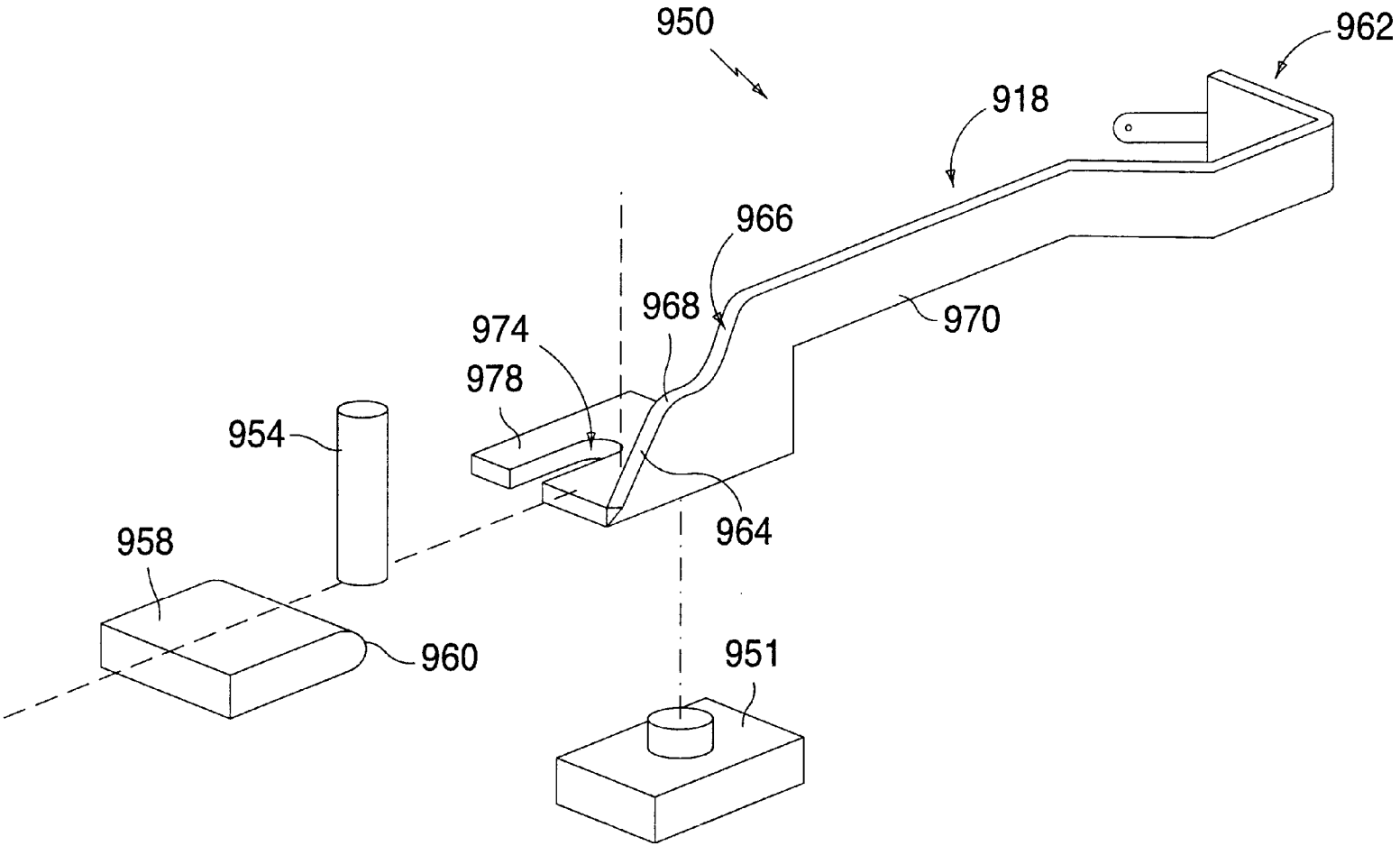
FIG. 39 is an exploded perspective view of various components within the backstrap module of FIG. 38.

Referring to FIGS. 38–39, a backstrap module 950 is configured to simulate the known double-action cocking and firing mechanisms, and includes an elongated trigger bar 918, a guide post 954, a microswitch 951, and a cam 958. The cam 958 is generally flat with a rounded front edge 960, and is anchored horizontally within the housing. The guide post 954 is a round steel bar anchored vertically within the housing proximate the cam 958.

The trigger bar 918 is fabricated from rectangular, 410 series stainless steel bar stock, and includes an elongated body section 970 situated between front and rear ends 962, 964. The front end 962 is configured as on trigger 15 shown in FIG. 35, and the rear end has a contoured profile with first and second cam surfaces 966, 968 which produces a trigger pull resistance which simulates the force in a conventional double action firing mechanism.

The first and second cam surfaces 966, 968 have different angles of inclination with respect to the guide post so that when the trigger 14 is pulled by the operator, mechanical feedback is provided to the operator in the form of differing amounts of trigger pull resistance. The first cam surface 966, having a higher angle of inclination than the second cam surface 968, produces force on the trigger generally equivalent to the initial trigger resistance in a traditional double-action firing mechanism. As the trigger is pulled further, the second cam surface 968 engages the cam 958, to provide the operator with a decreased trigger resistance.

The trigger bar 918 includes an actuation section 977 which is bent to form a generally horizontal plane and enabling actuation of the microswitch 918 in a generally downward movement. A slot 974 is oriented longitudinally, or generally parallel to the firing axis, to engage the trigger bar 951 on the guide post 954. The slot 974 is used to maintain proper alignment of the trigger bar 918 in the backstrap module 950 as the cam surfaces 966, 968 force downward movement of the trigger bar 918.

Figure 40:
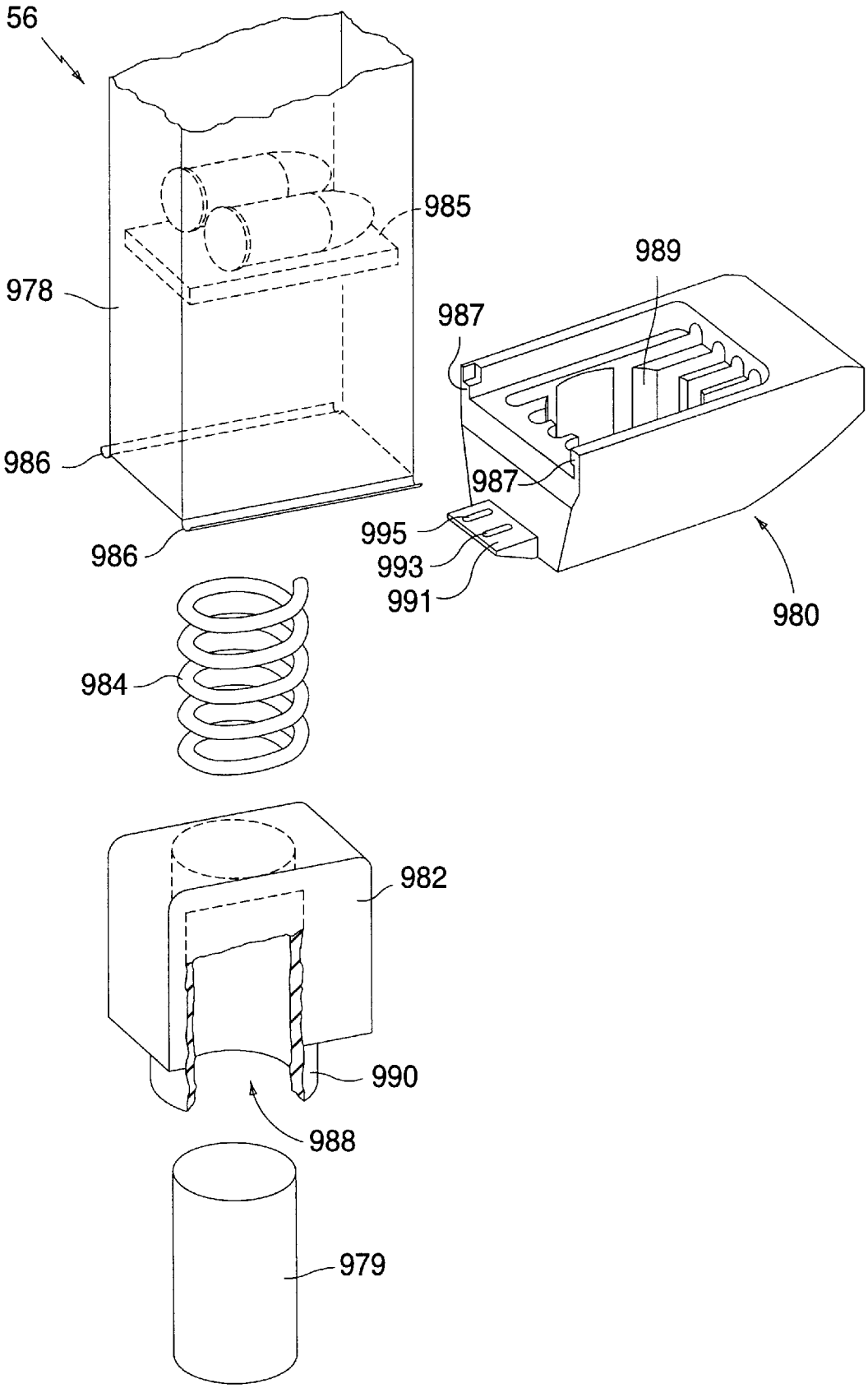
FIG. 40 is an exploded perspective view of the magazine of FIG. 2.
Figure 41:
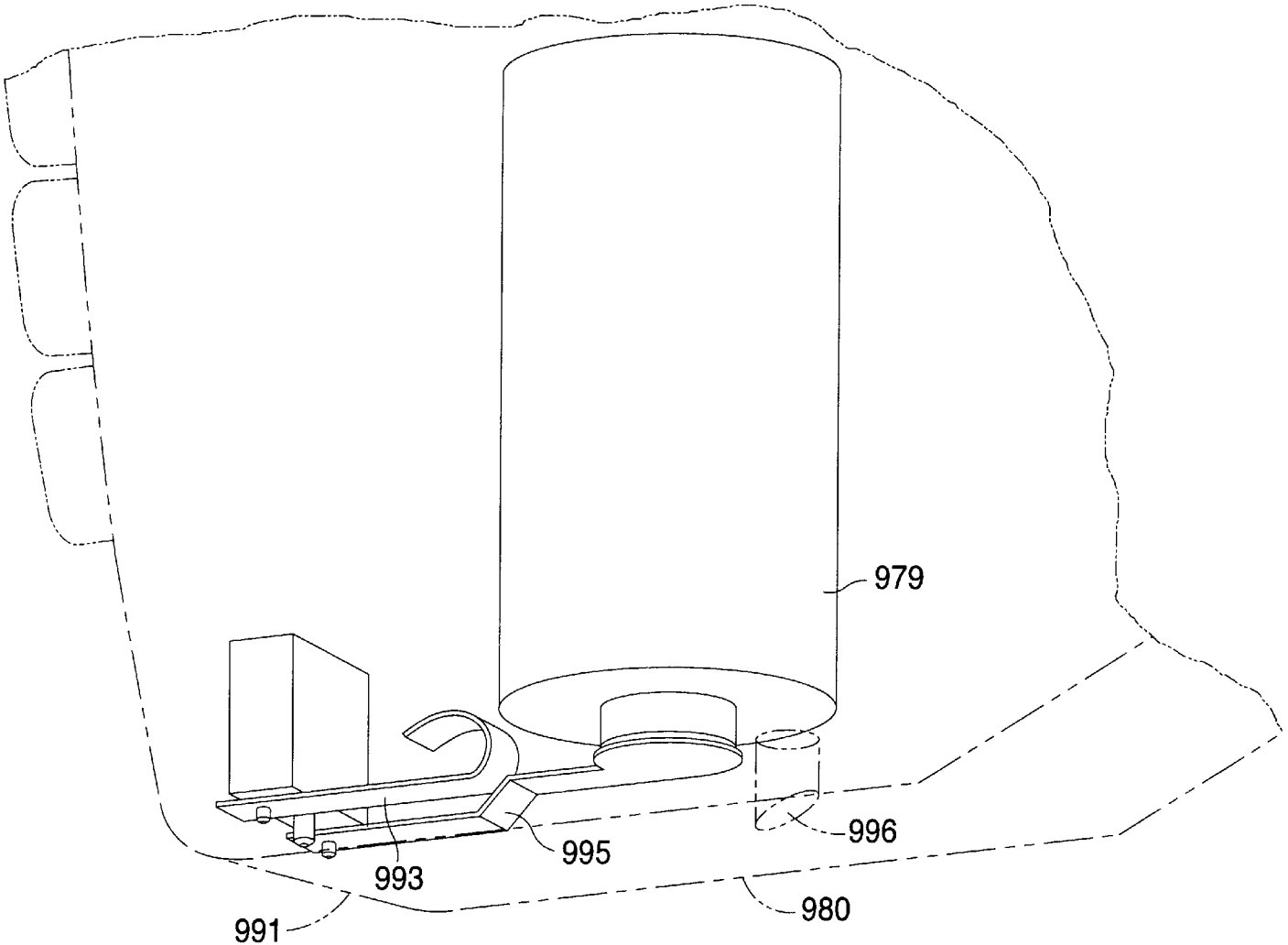
FIG. 41 is an enlarged perspective view of the underside of the magazine of FIG. 40.

Referring to FIGS. 40–41, the magazine 56 has a conventional, elongated metallic housing 978, a battery 979, an end cap 980, a battery retainer 982 and a magazine spring 984. A conventional follower 985 is disposed within the housing 978 above the magazine spring 984 to move cartridges upwardly in a uniform fashion under force of the magazine spring 984.

The housing 978 is configured for insertion into the pistol frame 12, as shown in FIG. 2, to store and feed unfired ammunition to the firing chamber, and includes a pair of edges 986 adapted to engage complimentary parallel grooves 987 of the end cap 980. The magazine spring 984 is inserted underneath the follower 985 to provide the force necessary to urge the stored cartridges toward the firing chamber. The battery retainer 982 is shaped to slide smoothly into the housing after the magazine spring 984 is in place.

The battery retainer 982 and the end cap 980 include blind bores 988, 989, respectively, which cooperate to enclose and protect the battery 979. A lip 990 depends from the underside of the retainer 982 to engage, and prevent removal of, the end cap 980.

An electrical contact pad 991 extends rearwardly from the end cap 980 and includes two spring-steel contacts 993, 995 which electrically engage the two downwardly depending terminals 718, 719 facing downwardly on the backstrap module bottom end 715, as shown in FIGS. 24 and 26. When the magazine 56 is inserted into the pistol 10 and locked into position on the pistol frame, the two contacts 993, 995 remain in continuous electrical contact with the terminals of the backstrap module 50.

The magazine 56 is assembled by first inserting, successively, the follower 985, the magazine spring 984 and retainer 982. The battery is inserted within the blind bore 988 of the retainer 982 and both are pressed upwardly together far enough so that the lip 990 is positioned above the edges 986 of the housing 978. The end cap 980 is then engaged with, and moved into proper position on, the housing 978, at which point the retainer and battery are pushed downwardly by the spring 984 until the battery bottoms out in the blind bore 989 of the end cap 980.

The magazine 56 is disassembled by inserting a conventional tool such as a pin wrench through a pin hole 996 defined through the underside of the end cap 980. The battery and retainer 982 are depressed simultaneously within the housing 978 using the pin wrench until the lip 990 of the retainer 982 will not interfere with removal of the end cap 980. Generally, it will be sufficient to move the retainer 982 so the lip is above the edge 986 of the housing 978. At this point, the end cap can be removed from the housing 978.

Now turning to a description of the steps involved in operating the pistol, a loaded cartridge can only be fired after a plurality of input signals are received by the security apparatus. The security apparatus will only authorize the firing apparatus to produce a high-voltage firing signal if each of the inputs is received, including a properly entered authorization code; a "loaded ammunition signal"; a mechanical trigger pull signal; and a magnetic trigger pull signal. In addition, a successive firing will not be authorized until a magnetic reset signal is received by the security apparatus.

The security apparatus is programmed with three operational modes: sleep and awake modes, and an authorization mode, or "intent-to-fire" mode. There is no "on/off" switch for the pistol, so it is always in one of the three operational modes. The least active of the modes is the sleep mode, which deactivates the LCD when the pistol is left alone for a predetermined amount of time. This mode is related to a feature known as a "slow grip," where the security apparatus automatically reverts to the sleep mode from any other mode to save battery power when the pistol has not been handled for a predetermined amount of time. The security apparatus includes logic that recognizes when open or closed circuit or any of the input switches is actuated, the security apparatus automatically "wakes up" and is prepared to receiver an authorization mode from the operator. Hence, the first method in which the input switches can be used is to wake the pistol from the sleep mode.

The input switches are used by the operator to enter an authorization code. The operator enters an authorization code or personal ID number (PIN) by depressing a preselected sequence of switches, similar in fashion to known coded devices. However, when the pistol is initially purchased from a dealership or the factory, the operator must enter a manufacturing code set at the factory which corresponds to the serial number of the pistol frame. Once the operator enters the proper manufacturing code, the security apparatus will then accept entry of his or her own personalized authorization code. It is apparent that the security apparatus can be programmed to allow the operator to change the authorization code if desired.

The input switches are to inform the security apparatus when the pistol is being gripped properly and in a manner with an intent to fire the pistol. Experiments have shown that the average user can consistently and simultaneously depress any two of the five input switches. Accordingly, the security apparatus will not authorize firing of the pistol unless at least two of the five input switches remain depressed.

Finally, the input switches are used to enter a cancellation code to purposely deactivate the pistol after an authorization code has been entered. Otherwise, the pistol could still be fired, for instance, after being put down for a short time period that is less than a predetermined automatic shut-off time period. To avoid unintentional entering of the cancellation code during use, the magazine must be removed prior to entering the cancellation code. The cancellation code can be changed, however, a representative code is three consecutive actuations of the bottom input switch.

The "loaded ammunition signal" is one produced by the security apparatus using a low voltage signal that is passed through a cartridge loaded in the firing chamber. The low-voltage signal travels through the cartridge and electrical resistance is measured and compared to a preselected value. If the round is chambered improperly, such as when jammed or misaligned with the probe tip, the resistance value will be other than optimum, and the loaded ammunition signal will not be satisfied. This signal obviously requires that the slide assembly be in its firing position so that the probe terminal and contact, as well as the ground terminal and contact, are properly engaged.

Two inputs are produced when the trigger is pulled: the signal produced by the magnetic sensor and the signal produced by the microswitch. As described above, the trigger magnetically actuates the sensor at a precise position, sending an electronic signal to the security apparatus. Without the trigger feedback signal, the security apparatus will not authorize the firing apparatus to produce a firing signal. Likewise, without the signal from the microswitch by mechanical actuation of the trigger, the security apparatus will not authorize the firing apparatus to produce a firing signal.

As mentioned above, the microswitch and magnetic sensor work together to prevent unintentional, successive firings of the firearm. Once the firearm fires a single cartridge, a next cartridge cannot be fired until the trigger has been recovered a distance which resets circuitry within the security apparatus. The recovery distance can be adjusted, but in any event should not be less than a distance corresponding to involuntary and/or unintentional trigger movement during normal trigger actuation during use that results from recoil action of the firearm.

It is considered within the scope of the present invention to adapt a circuitboard arrangement similar to the circuitboard arrangement 723 shown in FIGS. 28–29 for use in a firearm that is capable of discharging conventional, percussively-primed cartridges. In such an embodiment, the backstrap module 50 would be in communication with a security apparatus and a linear actuator, such as a solenoid or the like. One such arrangement is shown and disclosed in U.S. Pat. No. 4,793,085, which is hereby incorporated by reference into the present invention in its entirety.

In operation, the security apparatus would receives input signals which are indicative of compliance with the operating parameters described above, including entry of the personal authorization number by the firearm operator, gripping the input device sufficiently to actuate the proper arrangement of input switches on the handgrip, as well as actuation of the redundant trigger actuation switches. After the security apparatus registers compliance with the operating parameters, a signal would be supplied to the linear actuator to cause the linear actuator to deliver a blow to the firing pin, thereby detonating the cartridge.

It is apparent that other arrangements of components are possible to convert an electronic signal from the security apparatus into mechanical actuation of the firing pin. It is considered within the grasp of a person skilled in the art to adapt the security apparatus and backstrap module of the pistol herein described to a firearm which includes a solenoid or similar device to convert an electrical firing signal into mechanical movement which is sufficient to detonate a conventional percussive cartridge primer.

The embodiments of the present invention described in detail above are intended for use in a pistol. However, it should be understood that the principles can readily be applied to a variety of firearms, such as long guns, or other types of devices which utilize a non-impact form of detonating cartridge, such as, a nail gun. While preferred embodiments have been shown and described above, various modifications and substitutions may be made without departing from the spirit and scope of the invention. For example, various other forms of information can be displayed on the display screen for the operator, including an indication of the quantity of cartridges remaining in the magazine. In addition, other materials and methods of constructing the backstrap module and attaching it to the frame are considered within the scope of this invention.

Still further, other types of authorization input signals are known in various electronic arts and lend themselves to use in a firearm such as described herein, such as a fingerprint scanning device which recognizes the fingerprint of a person who is authorized to use the firearm. Still even further, it is within the scope of the invention to provide a power source mounted within the backstrap module, thereby obviating the need for several electrical contacts, which may become damaged or corroded during normal use.

Accordingly, it is to be understood that the present invention has been described by way of example and not by way of limitation.

What is claimed is:

1. A backstrap module configured to receive components and circuitry of a firearm capable of generating a firing signal from a firing apparatus for firing a non-impact ammunition cartridge along a firing axis, said backstrap module comprising:

a housing having an exterior surface which serves as a handgrip of said firearm, wherein an operator's hand would encircle said housing during a firing of said firearm;

a circuitboard arrangement comprising a rigid circuitboard portion and a flexible circuitboard portion, said circuitboard arrangement being accommodated within said housing and configured to conform to the contours of said housing;

a grounding terminal oriented to maintain abutment with a ground contact of a slide assembly of said firearm when said slide assembly is in a firing position; and said grounding terminal breaking abutment with said slide assembly when said slide assembly is moved in a rearward direction, thereby ensuring electrical discontinuity of said firing apparatus and prohibiting possible generation of said firing signal.

2. A backstrap module according to claim 1, wherein:

said housing includes a left half and a right half which are integrally matable with one another along a common mating line, said halves defining a downwardly facing contact pad when integrally mated; and said contact pad includes a plurality of electrical contact terminals.

3. A backstrap module according to claim 2, wherein:

said plurality of electrical contact terminals include a battery terminal for placing said circuitboard arrangement in electrical communication with a portable power source, and a external data port for enabling data communication between said circuitboard arrangement and an external device.

4. A backstrap module according to claim 2, wherein:

said halves further define a housing protrusion extending towards an operator in a rearward direction.

5. A backstrap module according to claim 4, wherein:

said circuitboard arrangement includes a rigid main circuitboard, a first flexible portion and a mountboard, said rigid main circuitboard being oriented approximately along a longitudinal axis of said housing;

said first flexible portion being curvedly attached between a first distal end of said rigid main circuitboard and said mountboard, wherein said mountboard extends in a rearward direction within said housing protrusion; and said rigid main circuitboard, said first flexible portion and said mountboard all being in electrical communication with one another.

6. A backstrap module according to claim 5, wherein:

said mountboard being oriented substantially parallel to said firing axis and supporting electrical components thereon; and said electrical components being mounted on a planar side of said mountboard closest to said slide assembly of said firearm.

7. A backstrap module according to claim 6, wherein:

said electrical components include said grounding terminal extending from said mountboard and supported by a terminal rail oriented on a top portion of one of said left and right halves of said housing.

8. A backstrap module according to claim 5, wherein:

said circuitboard arrangement further includes a second flexible portion and a keypad, said second flexible portion being curvedly attached between a second distal end of said rigid main circuitboard and said keypad, wherein planar surfaces of said keypad and said rigid main circuitboard are in opposition to one another; and said rigid main circuitboard, said second flexible portion and said keypad are all in electrical communication with one another.

9. A backstrap module according to claim 8, wherein:

said keypad is curved to conform to a back arcuate profile of said housing and has a pressure sensitive switch mounted on one planar side facing said back profile of said housing.

10. A backstrap module according to claim 9, wherein:

said keypad has a plurality of pressure sensitive switches mounted on one planar side facing said back profile of said housing;

said housing further includes a molded opening on said back profile which is centered about said mating line and opposed to said keypad, wherein a keypad cover is mounted within said housing to extend through said molded opening; and said keypad cover includes a plurality of raised input buttons in matching number with, and individually opposing, said plurality of said pressure sensitive switches for actuation of said plurality of pressure sensitive switches upon manual actuation of said raised input buttons.

11. A backstrap module according to claim 10, wherein:

said keypad cover is formed of a silicon material.

12. A backstrap module according to claim 8, wherein:

said circuitboard arrangement further includes a third flexible portion and a liquid crystal display, said third flexible portion being curvedly attached between said keypad and said liquid crystal display, wherein said liquid crystal display is viewable through a display opening in a rear face of said housing protusion, centered on said mating line; and said keypad, said third flexible portion and said liquid crystal display are all in electrical communication with one another, thereby permitting said liquid crystal display to display firearm information to said operator.

13. A backstrap module according to claim 12, wherein:

said circuitboard arrangement further includes a fourth flexible portion and a microswitch board, said fourth flexible portion being curvedly attached between said liquid crystal display and said microswitch board, wherein said microswitch board is oriented approximately parallel to said mountboard and includes a microswitch mounted on one planar side thereof; and said liquid crystal display, said fourth flexible portion and said microswitch board are all in electrical communication with one another.

14. A backstrap module according to claim 13, wherein:

said electrical components mounted upon said mountboard further include a magnetic sensor oriented in a predetermined relationship to said microswitch, wherein said magnetic sensor is actuated by passage of a trigger magnet adjacent said magnetic sensor; and said trigger magnet is disposed within a magnet bore of a trigger bar of said firearm, said trigger bar being manually actuated to initiate a firing operation of said firearm.

15. A backstrap module according to claim 14, wherein:

said predetermined relationship includes said magnetic sensor being positioned behind, above and to the left of said microswitch; and said microswitch is actuated by abutment with said trigger bar approximately simultaneously with actuation of said magnetic sensor.

16. A backstrap module according to claim 15, wherein:

said magnetic sensor is positioned approximately 0.262 inches behind said microswitch, approximately 0.056 inches above said microswitch and approximately 0.131 inches to the left of said microswitch; and an actuation axis of said microswitch is approximately aligned with a center axis of said trigger magnet.

17. A backstrap module according to claim 15, wherein:

said magnetic sensor includes a longitudinal axis approximately aligned with an actuation axis of said microswitch.

18. A backstrap module according to claim 14, wherein:

said trigger magnet includes a first axial portion and a second axial portion, said first axial portion having a larger cross-sectional area than said second axial portion wherein said first axial portion is disposed within said magnet bore; and said trigger magnet is secured within said magnet bore by a cover plate, said cover plate is fixed to said trigger bar and includes a magnet aperture formed in the middle thereof which is sized to allow passage of said second axial portion while prohibiting passage of said first axial portion.

19. A backstrap module according to claim 18, wherein:

said trigger bar is formed of 400 series stainless steel;

said cover plate if formed of 300 series stainless steel; and said trigger magnet is approximately 0.072 inches in thickness, thereby providing a predetermined magnetic flux density.

20. A backstrap module according to claim 14, wherein:

said trigger bar includes an upper camming surface having two cam portions for selective contact with an outwardly extending cam bar; and said cam bar is oriented approximately orthogonal to said cam portions, wherein actuation of said trigger bar causes said cam bar to selectively abut said cam portions in succession thereby issuing a tactile sensation to an operator of said firearm during said firing operation.

21. A backstrap module according to claim 20, wherein:

said cam portions each have a differing angle of inclination with respect to a longitudinal axis of said trigger bar, thereby delivering differing tactile sensations as said cam bar abuts said cam portions in succession.

22. A backstrap module according to claim 20, wherein:

said trigger bar further includes an actuation section extending approximately orthogonal to said trigger bar; and said actuation section includes an alignment slot for accommodating an alignment post fixed adjacent said cam bar, said alignment bar travelling along said alignment slot to ensure proper alignment of said trigger bar during operation.

23. A backstrap module according to claim 4, wherein:

said firearm includes a main frame body for integrally mating with said backstrap module, said frame body including a pair of mounting apertures formed in a rear section thereof;

said housing protrusion includes a matching pair of mounting holes which are in axial alignment with said mounting apertures when said backstrap module is mated with said frame body; and a mounting pin extends through said mounting apertures and said mounting holes to secure said backstrap module to said frame body.

24. A backstrap module according to claim 23, further comprising:

a hollow mount rivet extending through said mounting apertures and said mounting holes for accommodating said mounting pin, thereby protecting said backstrap module and said frame body from wear due to said mounting pin.

25. A backstrap module according to claim 4, further comprising:

an ejector for ejecting spent ammunition cartridges from said firearm after discharge, said ejector being oriented on an upper edge portion of said housing protrusion and secured thereon by an engaging member of said firearm when said backstrap module is mated to a frame body of said firearm.

* * * * *